US011970326B2

(12) United States Patent
D'Anglade

(10) Patent No.: US 11,970,326 B2
(45) Date of Patent: Apr. 30, 2024

(54) PAPERBOARD PROTECTIVE CORNER AND METHOD FOR MANUFACTURING THE SAME

(71) Applicant: ABZAC CANADA INC., Drummondville (CA)

(72) Inventor: Pierre-Michel D'Anglade, Drummondville (CA)

(73) Assignee: ABZAC CANADA INC., Drummondville (CA)

( * ) Notice: Subject to any disclaimer, the term of this patent is extended or adjusted under 35 U.S.C. 154(b) by 0 days.

(21) Appl. No.: 18/323,009

(22) Filed: May 24, 2023

(65) Prior Publication Data

US 2023/0382623 A1 Nov. 30, 2023

Related U.S. Application Data

(60) Provisional application No. 63/365,220, filed on May 24, 2022.

(51) Int. Cl.
*B65D 81/05* (2006.01)

(52) U.S. Cl.
CPC ..... *B65D 81/054* (2013.01); *B65D 2581/053* (2013.01)

(58) Field of Classification Search
CPC ..... B65D 81/054; B65D 81/056; B65D 2581/053; B65D 5/5033
USPC ..... 206/586
See application file for complete search history.

(56) References Cited

U.S. PATENT DOCUMENTS

| | | | | |
|---|---|---|---|---|
| 3,072,313 | A | 1/1963 | Svendsen | |
| 3,129,868 | A | 4/1964 | Jenk | |
| 3,337,111 | A | 8/1967 | Petriekis | |
| 3,511,464 | A | 5/1970 | Doll | |
| 3,672,952 | A | 6/1972 | Brown | |
| 3,725,170 | A | 4/1973 | Doll | |
| 3,734,389 | A | 5/1973 | Brown | |
| 3,879,253 | A | 4/1975 | Doll | |
| 4,399,915 | A | 8/1983 | Sorenson | |
| 4,771,893 | A | 9/1988 | Liebel | |
| 4,784,270 | A * | 11/1988 | Layer | B65D 81/054 206/320 |

(Continued)

FOREIGN PATENT DOCUMENTS

| | | |
|---|---|---|
| CA | 2043680 A1 | 1/1992 |
| CA | 2738558 C | 3/2014 |

(Continued)

OTHER PUBLICATIONS

"International Search Report and Written Opinion of the International Searching Authority", International Application No. PCT/CA2023/050707, dated Jul. 19, 2023, 12 pp.

*Primary Examiner* — Steven A. Reynolds
(74) *Attorney, Agent, or Firm* — Myers Bigel, P.A.

(57) ABSTRACT

A paperboard protective corner and a method for manufacturing a paperboard protective corner, the paperboard protective corner comprising: a corner body made of a single paperboard sheet comprising first and second side edges, the single paperboard sheet being folded onto itself to form the paperboard protective corner, the single paperboard sheet including a plurality of folds, both the first and second side edges being received in a corresponding fold so as to be unexposed to an exterior of the paperboard protective corner.

17 Claims, 21 Drawing Sheets

(56) References Cited

U.S. PATENT DOCUMENTS

| | | | | |
|---|---|---|---|---|
| 5,048,689 | A * | 9/1991 | McFarland | B65D 5/5033 206/453 |
| 5,161,692 | A | 11/1992 | Knierim | |
| 5,181,611 | A | 1/1993 | Liebel | |
| 5,613,335 | A | 3/1997 | Rennich | |
| 5,813,537 | A | 9/1998 | DeReu | |
| D407,647 | S | 4/1999 | Merricks | |
| 5,947,290 | A | 9/1999 | Loeschen | |
| 6,012,587 | A | 1/2000 | McCullough | |
| 6,334,535 | B1 | 1/2002 | Korhonen | |
| 6,527,119 | B1 | 3/2003 | Markert | |
| 6,540,080 | B2 | 4/2003 | Moreyra | |
| 6,794,018 | B2 | 9/2004 | Clark | |
| 6,915,603 | B2 | 7/2005 | Hunt | |
| 7,014,047 | B2 | 3/2006 | Stapleton | |
| 7,111,734 | B2 | 9/2006 | Robinson, Jr. | |
| 7,159,345 | B2 | 1/2007 | Hunt | |
| 7,216,765 | B2 | 5/2007 | Markert | |
| 7,299,924 | B2 | 11/2007 | Robinson, Jr. | |
| 7,383,952 | B2 | 6/2008 | Kruelle | |
| 7,434,682 | B2 | 10/2008 | Valenzano | |
| D584,621 | S | 1/2009 | Jean | |
| 7,661,579 | B2 | 2/2010 | Kruelle | |
| 7,727,614 | B2 | 6/2010 | Stubing | |
| 8,038,003 | B2 | 10/2011 | Rometty | |
| 8,443,975 | B2 | 5/2013 | Butch, Jr. | |
| 8,584,928 | B2 | 11/2013 | Keissner | |
| 8,753,731 | B2 | 6/2014 | Dunn | |
| 9,169,063 | B2 | 10/2015 | Ulrich | |
| 9,764,527 | B2 | 9/2017 | D'Anglade | |
| 10,099,444 | B2 * | 10/2018 | D'Anglade | B31D 5/006 |
| 10,137,657 | B2 | 11/2018 | Ulrich | |
| 2001/0001446 | A1 | 5/2001 | Moreyra | |
| 2002/0189969 | A1 | 12/2002 | Renck | |
| 2004/0255537 | A1 | 12/2004 | Dalgleish | |
| 2004/0262193 | A1 | 12/2004 | Korhonen | |
| 2005/0082200 | A1 * | 4/2005 | Robinson | B65D 81/054 206/521 |
| 2005/0087663 | A1 * | 4/2005 | Schroeder | B65D 81/054 206/586 |
| 2005/0121356 | A1 | 6/2005 | Wisecarver | |
| 2005/0121357 | A1 * | 6/2005 | Robinson | B65D 81/054 206/586 |
| 2009/0057380 | A1 | 3/2009 | Rometty | |
| 2011/0180450 | A1 | 7/2011 | Hainer | |
| 2012/0000815 | A1 | 1/2012 | Butch, Jr. | |
| 2013/0277418 | A1 | 10/2013 | Van Berlo | |
| 2014/0050897 | A1 | 2/2014 | Rometty | |
| 2014/0069842 | A1 * | 3/2014 | D'Anglade | B31D 3/04 493/128 |
| 2015/0307230 | A1 | 10/2015 | Ulrich | |
| 2020/0079065 | A1 * | 3/2020 | Begrow | B32B 3/04 |
| 2021/0171264 | A1 | 6/2021 | Jette | |

FOREIGN PATENT DOCUMENTS

| | | | |
|---|---|---|---|
| CA | 2832460 | C | 7/2015 |
| CA | 2950194 | C | 7/2017 |
| CA | 2876225 | C | 10/2018 |
| GB | 1058168 | A | 2/1967 |
| JP | H06115567 | A | 4/1994 |
| JP | 3074592 | U | 1/2001 |
| JP | 5229574 | B2 | 11/2010 |
| TW | M297354 | U | 9/2006 |
| WO | 2012003054 | A1 | 1/2012 |
| WO | 2015140640 | A2 | 9/2015 |
| WO | 2016000740 | A1 | 1/2016 |
| WO | 2016207504 | A1 | 12/2016 |
| WO | 2017020113 | A1 | 2/2017 |

* cited by examiner

PAPERBOARD PROTECTIVE CORNER AND METHOD FOR MANUFACTURING THE SAME

TECHNICAL FIELD

The technical field generally relates to protective corners to protect products or goods from impacts, for example when stored, transported, or shipped, and to methods for manufacturing the same.

BACKGROUND

L-shaped protective corners (also know as "edge protectors" or "angles") are usually placed along the corners or edges of products (typically rectangular products or products stacked on a pallet) to protect the product from being damaged during storage, transportation or shipping from one destination to another.

Some existing protective corners are usually made from thick and dense cardboard, such as corrugated cardboard. Unfortunately, corrugated cardboard may be relatively expensive and time-consuming to produce.

Other existing protective corners may be made of a plurality of sheets of non-corrugated paperboard (i.e., paper that is not corrugated cardboard) that are wrapped around each other in an L-shape to form multiple plies of the corner. Typically, the sheets are wrapped around an L-shaped central core member. Unfortunately, this may require the manipulation of multiple paper sheets which may make the process of manufacturing the protective corner relatively complex, and time-consuming.

SUMMARY

According to one aspect, there is provided a paperboard protective corner comprising: a corner body made of a single paperboard sheet comprising first and second side edges, the single paperboard sheet being an unlaminated paperboard sheet having a thickness between about 6 pts and about 17 pts, the single paperboard sheet being folded onto itself to define first and second wings having each at least five layers from the single paperboard sheet, the first and second wings having corner ends each comprising a plurality of folds, both the first and second side edges being nested in or adjacent to a corresponding fold so as to be unexposed to an exterior of the paperboard protective corner.

In at least one embodiment, the first and second wings being angled relative to each other to form a central apex therebetween, the apex resisting a crushing force of at least 90 N.

In at least one embodiment, a thickness of the first and second wings is 2 mm or more, the apex resisting a crushing force of at least 300 N.

In at least one embodiment, a thickness of the first and second wings is between 2 mm and 5 mm, the apex resisting a crushing force between 300 N to 5700 N.

In at least one embodiment, the single paperboard sheet is folded according to a first folding pattern to form a first multilayered intermediate sheet, the multilayered intermediate sheet being further folded according to a second folding pattern to form a second multilayered intermediate sheet, the second multilayered intermediate sheet being bent at an angle of about 90 degrees to form the apex of the paperboard protective corner.

In at least one embodiment, the second folding pattern is similar to the first folding patter.

In at least one embodiment, the corner body extends between the first and second corner ends, and wherein the plurality of folds includes a first plurality of folds located at the first corner end, the first plurality of folds including an outer fold, a first intermediate fold nested in the outer fold, a second intermediate fold nested into the first intermediate fold and an inner fold nested into the second intermediate fold.

In at least one embodiment, the plurality of folds further includes a second plurality of folds located at the second corner end, the second plurality of folds including a first outer fold and a second outer fold located adjacent to the first outer fold.

In at least one embodiment, the first and second wings each comprises nine layers from the single paperboard sheet.

In at least one embodiment, the paperboard sheet 200 has a grammage of between about 100 g/m$^2$ and about 380 g/m$^2$.

In at least one embodiment, the plurality of folds includes more than four folds.

According to another aspect, there is also provided a method for manufacturing a paperboard protective corner, the method comprising: providing a paperboard sheet comprising a first surface and a second surface opposite the first surface, the single paperboard sheet comprising first and second side edges, the paperboard sheet further comprising a first side portion, a second side portion and a central portion extending between the first and second side portions; folding the first side portion of the paperboard sheet over the central portion of the paperboard sheet; folding the second side portion of the paperboard sheet over the first side portion of the paperboard sheet to thereby create a multilayered intermediate sheet; and folding the multilayered intermediate sheet at an apex to form the paperboard protective corner where both the first and second side edges are nested in or adjacent to a corresponding fold so as to be unexposed to an exterior of the paperboard protective corner.

In at least one embodiment, the multilayered intermediate sheet is a first multilayered intermediate sheet comprising a first side portion, a second side portion and a central portion, folding the multilayered intermediate sheet comprising: folding the first side portion of the first multilayered intermediate sheet over the central portion of the first multilayered intermediate sheet; folding the second side portion of the first multilayered intermediate sheet over the first side portion of the first multilayered intermediate sheet to thereby create a second multilayered intermediate sheet; and folding the second multilayered intermediate sheet to form the paperboard protective corner.

In at least one embodiment, the method further comprises moving the paperboard sheet longitudinally along a paperboard protective corner production line.

In at least one embodiment, moving the paperboard sheet longitudinally is performed simultaneously to at least one of folding the first side portion, folding the second side portion and folding the multilayered intermediate sheet.

In at least one embodiment, moving the paperboard sheet longitudinally comprises moving the paperboard sheet longitudinally at a speed of between about 0 m/s and 300 m/s.

In at least one embodiment, moving the paperboard sheet longitudinally comprises moving the paperboard sheet longitudinally at a speed of more than 200 m/s.

According to another aspect, there is also provided a paperboard protective corner comprising a single paperboard sheet folded according to a first folding pattern to form a first multilayered intermediate sheet, the multilayered intermediate sheet being further folded according to a second folding pattern to form a second multilayered intermediate sheet, the second multilayered intermediate sheet being bent at an angle of about 90 degrees to form the paperboard protective corner with first and second wings, the second folding pattern being similar to the first folding pattern.

In at least one embodiment, the single paperboard sheet has a width defined between first and second side edges, the first and second side edges being located between layers of the first and second wings so as to be unexposed to an exterior of the paperboard protective corner.

In at least one embodiment, a thickness of the first and second wings is between 2 mm and 5 mm, the apex resisting a crushing force between 300 N to 5700 N.

DETAILED DESCRIPTION

Figure 1:
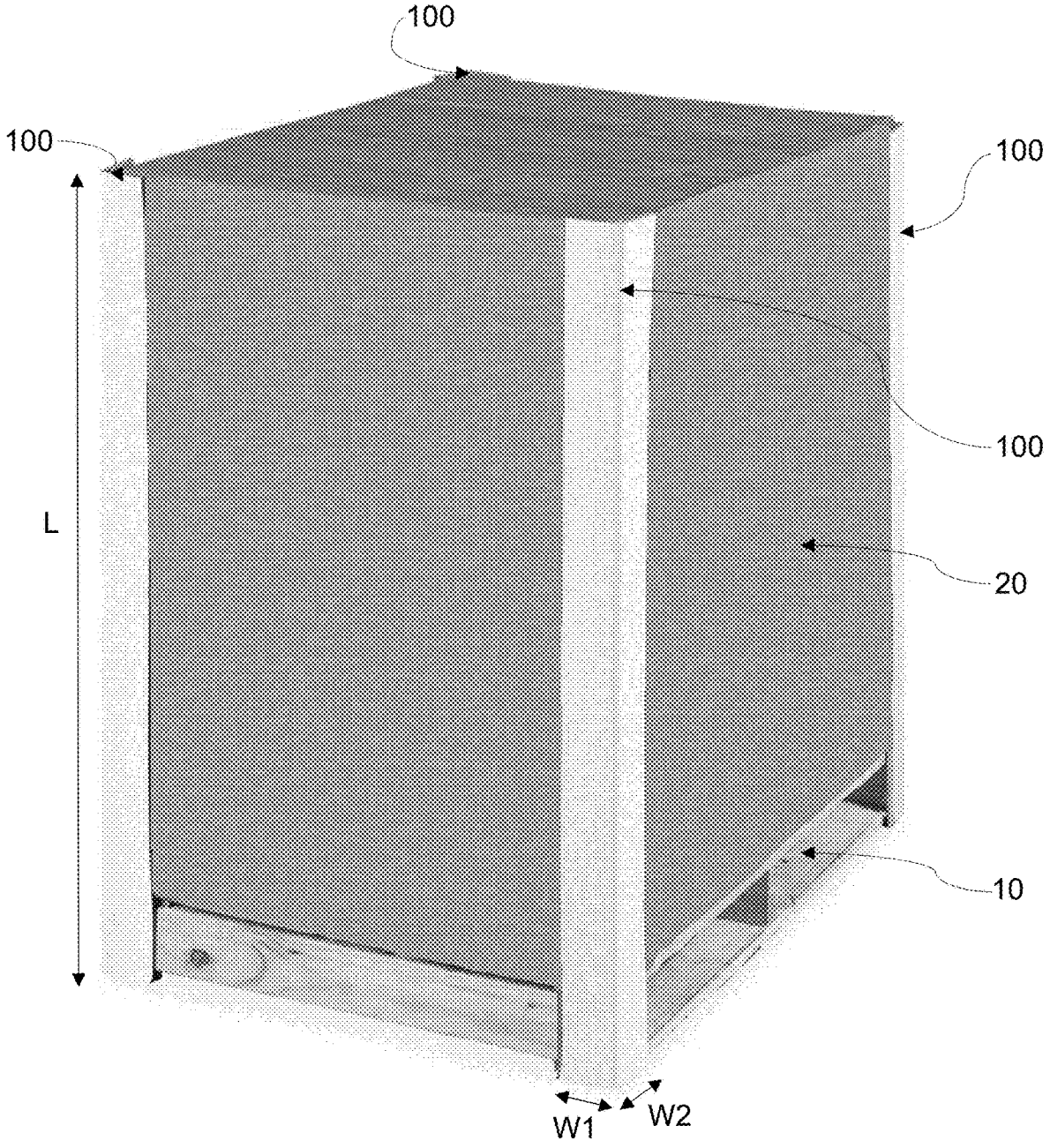
FIG. 1 is a perspective view of a pallet with protective corners mounted on each corner, in accordance with one embodiment.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "top", "bottom", "forward", "rearward" "left", "right" and the like should, unless otherwise indicated, be taken in the context of the figures and correspond to the position and orientation in the paperboard protective corner and corresponding parts when being used. Positional descriptions should not be considered limiting.

The term "point" is used in the art to measure thickness of a paper sheet or of a paperboard sheet, where 10 points are equivalent to 0.010 in. or 0.25 mm.

Furthermore, the expressions "bend" and "fold" are meant in the sense of curving, deflecting or forming a curvature in a paper sheet.

The paperboard protective corners as described herein are primarily designed to protect corners or edges of products, such as cases stacked on a pallet during storage, transportation or shipping, home appliances and furniture, as examples only. The protective paperboard protective corners may be used with other types of devices and/or products, and in other fields, as apparent to a person skilled in those arts. The paperboard protective corners can also be referred to as edge protectors or angles.

In addition, although the preferred embodiments of the present invention are illustrated with certain geometrical configurations as explained herein, not all of these configurations and geometries are essential to the invention and thus should not be taken in their restrictive sense, i.e., should not be taken as to limit the scope of the present invention.

Referring to FIG. 1, there is provided a pallet 10 with a load 20 on it, each corner of the load being protected by a paperboard protective corner 100. The pallet 10 may be any standard pallet normally used for transporting goods, and the load 20 may be any type of load that request protection on the corner, such as for example, household appliances, stacked boxes of wine, stacked boxes of tableware, or any fragile goods that request a certain level of protection.

The paperboard protective corner 100 is an elongated piece of rigid paperboard bent at an angle, usually 90° to form a first wing and a second wing, the paperboard protective corner 100 can be used to protect the edges or corners of unit loads from scratches or other impacts during transport. They may also be used to facilitate the wrapping of stacked products with stretch film.

In some embodiment, the paperboard protective corner 100 can have a length L of between about 1 m and about 6 m, or between about 2 m and 4 m, and preferably about 2 m. In a preferred embodiment, the length of the first wing w1 equals the length of the second wing w2, such as the paperboard protective corner 100 is symmetrical. Alternatively, the length of the first wing w1 could be different than the length of the second wing w2, in an asymmetric configuration. The size of each wing w1, w2 can be between 15 mm and 80 mm, and preferably between 20 mm and 60 mm, and most preferably about 50 mm.

Figure 2:
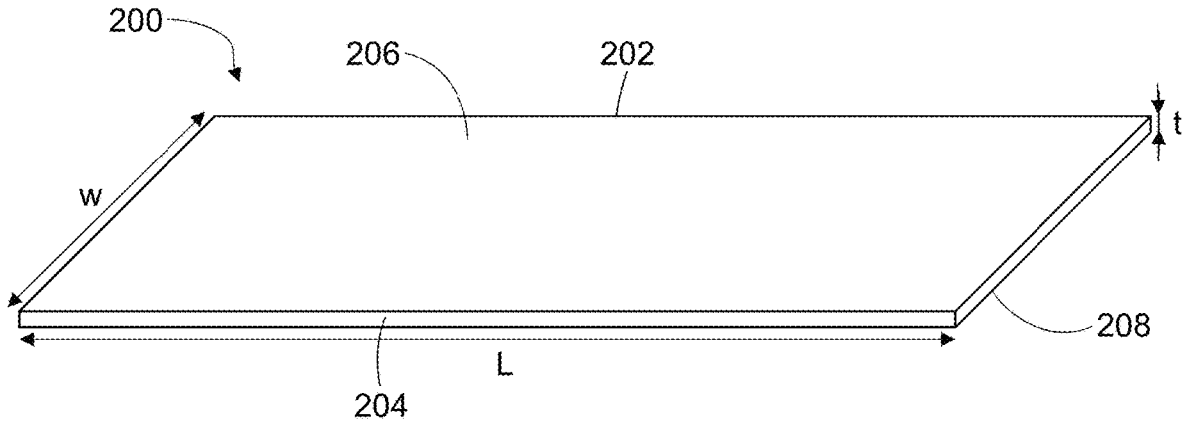
FIG. 2 is a perspective view of a single paperboard sheet used to form the paperboard protective corner illustrated in FIG. 1, in accordance with an embodiment.

Referring to FIG. 2, there is provided a single paperboard sheet 200 that can be used to form the paperboard protective corner 100, by folding the single paperboard sheet 200 onto itself, as will be further described below. The single, unlaminated paperboard sheet is supplied in the form of a roll, the sheet having a length much greater than its width. According to an embodiment, the paperboard protective corner 100 is manufactured in a plant, in a continuous manufacturing process, where the single paperboard sheet is unwound at a given speed by an automated and controlled unwinder. The unwound paperboard sheet, which may also be referred to as an unlaminated paperboard sheet, is guided and folded using mechanical guide as the sheet is pulled and moved along the manufacturing line. The mechanical guides are typically rigid, metallic parts, located along the manufacturing line, used to bend and fold the sheet travelling along the production line in different sections or portions, until the desired configuration is reached. The mechanical guides can have a V-shape cross-section which gradually change from a wider opening to a narrower opening, forcing the sheet to bend and fold as it contacts the guide. Adhesive can be applied at different steps of the process to maintain the folded sections or portions together. In preferred embodiments, the paperboard protective corners are cut from the folded sheet at the end of the process.

Still referring to FIG. 2, the paperboard sheet 200 comprises a first face 206 and a second face 208 opposite the first face 206. In one embodiment, the paperboard sheet 200 can have a length L between about 1 m and about 6 m, or between about 2 m and 4 m, and most preferably about 2 m, and having a width w between about 27 cm and about 1.45 m, or between about 36 cm and 1.1 m, and most preferably about 90 cm. While FIG. 2 shows the paperboard sheet having a definite length L, corresponding to the length of the protective paperboard protective corner once finished, in reality the paperboard sheet used to manufacture the paperboard protective corner has an "indefinite" length as it is continuously unwound from paper rolls during the manufacturing process. The paperboard protective corners are preferably cut to length L only at the end of the manufacturing process, and thus before cutting the paperboard into separate, distinct paperboard protective corners, the sheet is as long as the manufacturing line, from the unwinding station to the cutting station. The width of the sheet is delimited by side edges 202, 204. Preferably, the paperboard sheet used to form the paperboard protective corners can be used directly from the paper rolls, without having to modify the width of the sheet, i.e., without having to cut the sheet longitudinally, and as explained above, a single sheet is used and folded to form the entirety of the paperboard protective corner.

In one embodiment, the paperboard sheet 200 further has a thickness between about 6 pts and about 17 pts, or between about 5 pts and about 15 pts, the variation of the thickness affecting the resistance force of the paperboard protective corner 100. In one embodiment, the paperboard sheet 200 is a single layer or ply of unlaminated and non-corrugated paperboard. The paperboard sheet can be made of virgin kraft paper, or recycled kraft paper, or a combination of both. Some water-resistant paperboards can also be used. Alternatively, the paperboard sheet 200 could include any other suitable paperboard. More specifically, in one embodiment, the paperboard sheet 200 can have a grammage (or density) of between about 80 g/m$^2$ and about 350 g/m$^2$, and particularly between about 100 g/m$^2$ and about 200 g/m$^2$, and most preferably about 140 g/m$^2$. The density selected for the paperboard sheet 200 can be a compromise between a high density for rigidity and a low density for flexibility and foldability.

It must of course be considered that the folding steps explained in the subsequent paragraphs are carried out in an automated manner on a production line, as a continuous or "in-line" process In one embodiment, the paperboard sheet 200 can have a humidity ratio of less than 12%, preferably less than 9.5%, or preferably less than 8%, and still preferably between 4% and 8%. It is understood that a higher ratio of humidity will improve the foldability of the paperboard sheet 200 and will prevent tearing of the paperboard when folded. However, higher humidity ratio may reduce the edge crush resistance of the paperboard protective corner.

Figure 3:
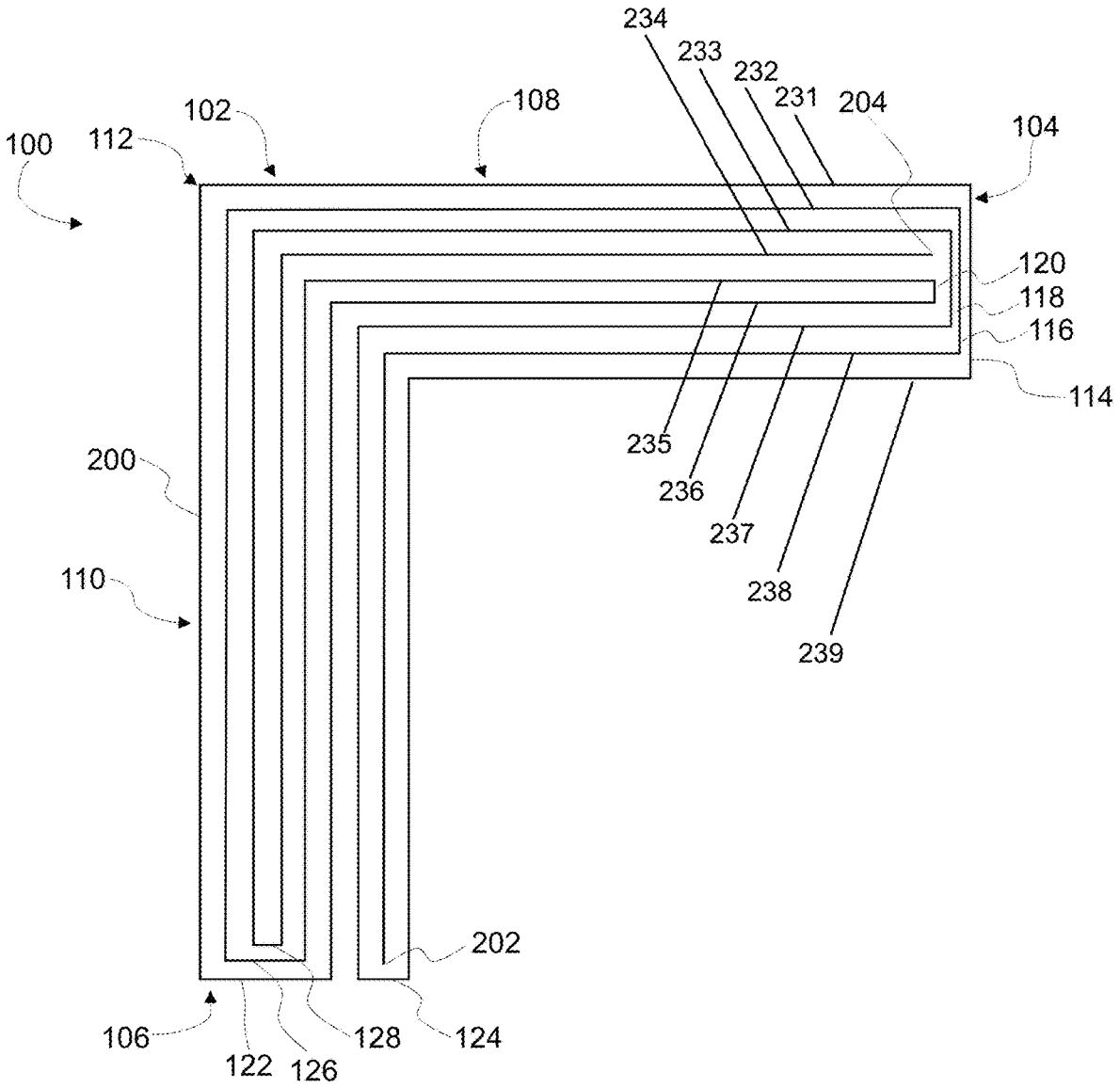
FIG. 3 is a cross-section view of a paperboard protective corner, in accordance with a first embodiment.

Referring to FIG. 3, there is provided a paperboard protective corner 100, in accordance with a first embodiment. In this embodiment, the paperboard protective corner 100 includes a single, unlaminated paperboard sheet 200 which is folded onto itself to form the paperboard protective corner 100. Using a single paperboard sheet rather than multiple sheets facilitates the manufacturing of the paperboard protective corner 100 and may reduce the cost associated with the manufacturing of the paperboard protective corner 100. In particular, using a single paperboard sheet reduces raw material needed to make the paperboard protective corners, limits the recut (less waste of material) and reduces the overall manufacturing cost (less resources consuming such as operators, electricity or water), resulting in a green technology that helps mitigate environmental impacts of paperboard protective corners' manufacturing. The use of a single sheet also reduces the space or footprint required in a plant to manufacture the paperboard protective corners, since only one paper roll, and therefore only one unwinder, is needed to form the corners. The proposed corner and the associated fabrication process eliminates the complexity of managing multiple rolls of paper in the production line. Synchronizing the unwinding of multiple rolls in the manufacturing process is a finicky process and problems with one roll can affect the management of the other rolls of the line. Restarting a production line when only one roll is involved, rather than having to manage the synchronization of multiple rolls, limits production downtime and allows, when there are issues, to restart the production more rapidly. Moreover, the paperboard sheet 200 may be made from non-corrugated paperboard and still form a paperboard protective corner which provides sufficient protection characteristics, which further reduces the costs and complexity of manufacturing the paperboard protective corner 100. Surprisingly, the use of a single sheet of paper, unlaminated, makes it possible to obtain an all-paper corner having an equivalent resistance to crushing forces (applied on the apex), and, depending on the folding method, superior to traditional corners, which typically include either a rigid core, or a series of laminated sheets, as will be explained in more detail with reference to FIG. 14.

Still referring to FIG. 3, and also to FIGS. 4A to 4E, the paperboard sheet 200 can be folded into a first multilayered intermediate sheet, which can further be folded into a second multilayered intermediate sheet—either using the same folding pattern or a different folding pattern—which has more layers than the first multilayered intermediate sheet. Moreover, each folding of the paperboard sheet 200 creates corners or folds between adjacent folded sheet portions, which contribute to reinforcing the paperboard protective corner 100.

In the illustrated embodiment, the paperboard protective corner 100 includes a corner body 102 extending between first and second corner ends 104, 106. The corner body 102 includes a first wing 108 and a second wing 110 angled relative to the first wing 108 to form a central apex 112 between the first and second wings 108, 110. In this embodiment, the first and second wings 108, 110 are angled relative to each other at an angle of about 90 degrees. Alternatively, the first and second wings 108, 110 could be angled at an angle of more or less than 90 degrees.

In the embodiment illustrated in FIG. 3, the first wing 108 has a first wing length and the second wing 110 has a second wing length which is substantially equal to the first wing length. In other words, the first corner end 104 is spaced from the central apex 112 by a first distance, and that the second corner end 106 is spaced from the central apex 112 by a second distance which is substantially equal to the first distance.

It will be understood that the paperboard protective corner 100 illustrated in FIG. 3 is not limited to any specific length and may have any suitable length. In the illustrated embodiment, the paperboard protective corner 100 is formed by folding the carboard sheet so as to create nine layers of paperboard 231, 232, 233, 234, 235, 236, 237, 238, and 239.

Since the paperboard protective corner 100 includes only a single carboard sheet 200 having first and second side edges 202, 204, the paperboard protective corner 100 also includes only the two side edges 202, 204. In the illustrated embodiment, the carboard sheet 200 is folded such that the first and second sheet side edges 202, 204 are not exposed to the exterior, but are instead received inside folds formed in the carboard sheet 200. The exposed side edges of the sheet forming the paperboard protective corners can more easily be peeled off, which can possibly affect the integrity of the corner. Forming the paperboard protective corner so that the side edges of the sheets are inside and embedded in the wings avoid their disbanding or peeling from the body of the corner.

Specifically, the first corner end 104 of the paperboard protective corner 100 includes four folds: an outer fold 114, a first intermediate fold 116 nested into the outer fold 114, a second intermediate fold 118 nested into the first intermediate fold 116 and an inner fold 120 nested into the second intermediate fold 118. In this embodiment, the second side edge 204 of the paperboard sheet 200 is adjacent the inner fold 120 and is received in the second intermediate fold 118 alongside the inner fold 120.

Still in the illustrated embodiment, the second corner end 106 of the paperboard protective corner 100 includes a first outer fold 122 and a second outer fold 124 located adjacent to the first outer fold 122. The second corner end 106 further includes an intermediate fold 126 nested into the outer fold 122 and an inner fold 128 nested into the intermediate fold 126. In this embodiment, the first side edge 202 of the paperboard sheet 200 is received in the second outer fold 124.

In this embodiment, the paperboard protective corner 100 therefore includes nine folds: four at each corner end 104, 106 and the central apex 112 forming a ninth fold. As stated above, these folds serve to strengthen and reinforce the paperboard protective corner 100.

For example, in one embodiment, the apex could have a resistance force of at least about N or at least about 20 lbs, and specifically of between about 100 lbs or about 445 N to about 1280 lbs or about 5680 N, and more specifically of between about 200 lbs or about 890 N and 400 lbs or about 1780 N, depending on the wall thickness of the paperboard protective corner. It is noted that the wall thickness of the paperboard protective corner corresponds to the thickness of each of the first and second wings constituting the corner body of the paperboard protective corner. The resistance force of the apex may be determined experimentally. For example, in one embodiment, the paperboard protective corner 100 may be placed on two blocks, each block being 1.5 inches in width and being separated by about a distance D of about 8 inches, which distance corresponds substantially to the length of the paperboard protective corner to be tested. A force F is applied at a rate of roughly 2"/minute to the middle of the paperboard protective corner 100 so mounted, at the apex 112, and the force F measured at the moment that the paperboard protective corner 100 fractures is the resistance force. Alternatively, different distance D (or different length L of the paperboard protective corner) can be considered, such as 10 inches for example. Highest distance D (i.e., highest length L of the paperboard protective corner) may result in lower resistance force F. In an embodiment, the experimental values obtained for a certain length L of the paperboard protective corner can be extrapolated for a different length L' of the paperboard protective corner, while experimentation and measurement with the paperboard protective corner of the different length L' is recommended for accurate results. Alternatively, the resistance of the apex and/or of the paperboard protective corner 100 may be measured using any other suitable method. It appears that the use of a single continuous sheet, rather than multiple layers of distinct, laminated sheets, allows the corner to better resist crushing forces applied at the apex, as there are no breaks and discontinuities in the material forming the entirety of the paperboard protective corner.

Table 1 below shows example results of resistance tests performed according to the testing protocol described above on a plurality of paperboard protective corners (14 samples) having different corner wall thicknesses ranging from about 3.5 mm to about 5 mm, and different humidity level ranging from about 4.6% to about 5.4% of humidity, the plurality of paperboard protective corners being configured as described above. Specifically, the tests were performed on corners having a length L of about 8 inches (20 cm), and with symmetrical wings, both having a width w1, w2 of about 2 inches (50 mm).

TABLE 1

Resistance force vs wall thickness and humidity level for several corners' samples

| Wall thickness (in/mm) | Humidity (%) | Sample # | Resistance Force (N) | Average Resistance Force (N) |
|---|---|---|---|---|
| 0.14"/3.5mm | 5.4 | #1 | 2680.3 | 2286.35 |
| | 4.6 | #2 | 2450.1 | |
| | 4.7 | #3 | 2158.7 | |
| | 4.7 | #4 | 1856.3 | |
| 0.16"/4 mm | 5.4 | #5 | 3374.6 | 3359.77 |
| | 4.6 | #6 | 3399.7 | |
| | 5 | #7 | 3305 | |
| 0.18"/4.5 mm | 5 | #8 | 4043 | 4136.38 |
| | 4.9 | #9 | 4472.1 | |
| | 4.9 | #10 | 3765.1 | |
| | 4.7 | #11 | 4265.3 | |
| 0.2"/5 mm | 4.7 | #12 | 5389.5 | 5461.37 |
| | 5.4 | #13 | 5314.6 | |
| | 4.8 | #14 | 5680 | |

It can be observed that the corners having the above-described configuration have a substantially high resistance force, higher than the conventional corners. For example, for corners having a wall thickness of about 3.5 mm, the paperboard protective corner had an average resistance of about 2286 N. According to these results, it will be understood that it would be possible to manufacture a corner similar to the paperboard protective corner as described above with a wall thickness wt0 which would have substantially the same resistance than a conventional corner having a wall thickness t1, with wt0 being substantially smaller than wt1, thereby substantially reducing the required amount of paperboard needed to manufacture a paperboard protective corner. Moreover, this would also substantially reduce the weight and the space occupied by each corner, which may substantially reduce the costs associated with the transportation of the corners.

Still referring to Table 1, a resistance test was also performed on a paperboard protective corner as described above and having a wall thickness of about 4.5 mm and 5 mm. The resistance of the paperboard protective corner was observed to be between about 3765 N and 4470 N, and between about 5300 N and 5680 N, respectively. It is noted that the average resistance force can be substantially a linear function or relation of the wall thickness. While Table 1 does not display the average resistance force for a wall thickness of 2 mm, by extrapolating the values of Table 1, it is noted that the resistance of the paperboard protective corner with a wall thickness of 2 mm can be at least 300 N, or more preferably at least 350 N. In other words, the apex of the paperboard protective corner having a wall thickness (or thickness of the first and second wings) of between 2 mm and can resist to a crushing force of between 300 N and 560 N, respectively.

Still in this embodiment, having the ends 202, 204 of the paperboard sheet 200 received into the folds 118, 124 substantially prevents the ends 202, 204 from becoming undone, which could potentially cause the entire corner 100 to unravel. It also prevents the ends 202, 204 from being snagged, which could damage the corner and also cause the ends 202, 204 to become undone.

First Embodiment—9 Layers

Referring now to FIGS. 4A to 4E, the different steps of the process to manufacture the paperboard protective corner 100 are shown, where the paperboard sheet 200 is first provided.

Figure 4A:
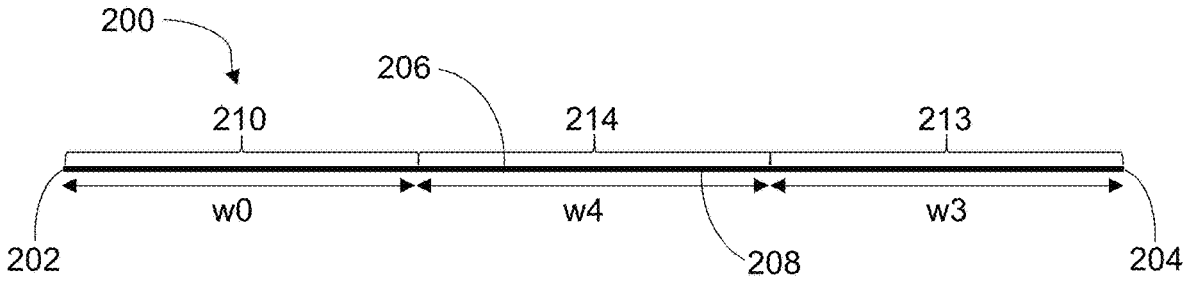
FIGS. 4A-4E are front elevation views showing folding steps of a method for manufacturing the paperboard protective corner illustrated in FIG. 3, in accordance with one embodiment.

As shown in FIG. 4A, the paperboard sheet 200 has a first face 206 and a second face 208 opposite the first face 206. The paperboard sheet 200 includes a first side portion 210 located adjacent the first side edge 202, a second side portion 213 located adjacent the second side edge 204 and a central portion 214 extending between the first and second side portions 210, 213.

Figure 4B:
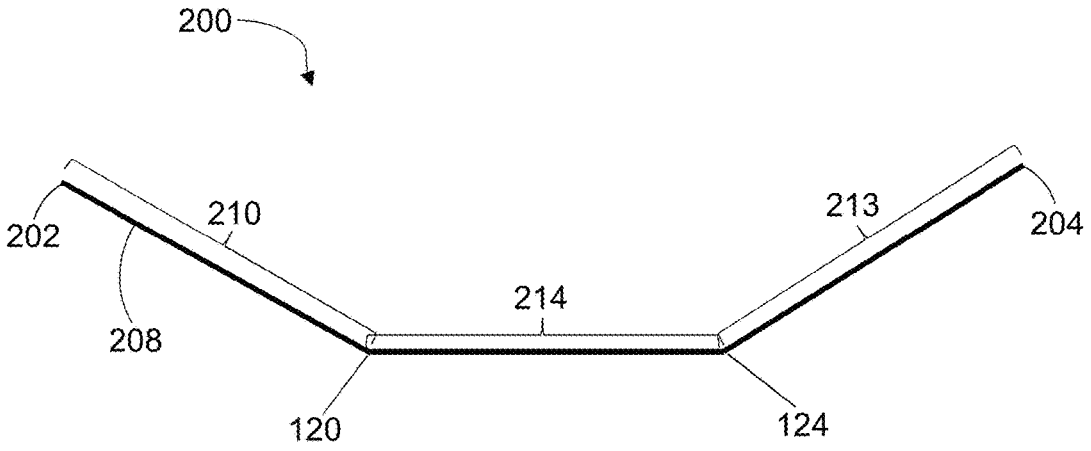
Figure 4C:
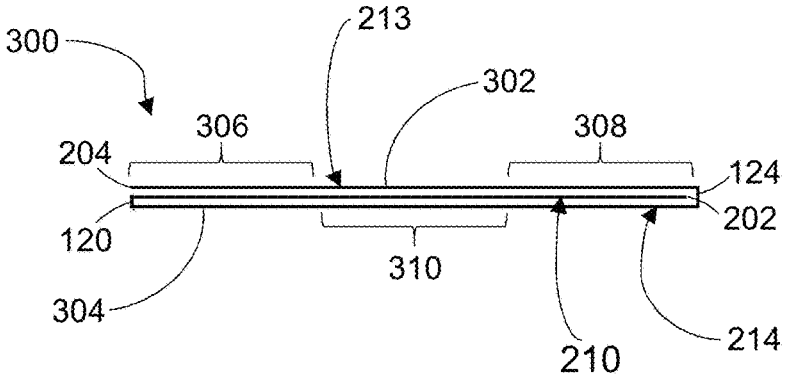

As shown in FIGS. 4B and 4C, the paperboard sheet 200 is folded according to a first folding pattern. Specifically, the paperboard sheet 200 is folded such that the first and second side portions 210, 213 are folded on the central portion 214. More specifically, the first side portion 210 is folded onto the central portion 214 such that the first face 206 of the first side portion 210 extends over the first face 206 of the central portion 214. The second side portion 213 is then folded onto the first side portion 210 such that the first face 206 of the second side portion 213 extends along the second face 208 of the first side portion 210.

In this configuration, folding the first side portion 210 over the central portion 214 forms a fold corresponding to the inner fold 120 of the first corner end 104 and folding the second side portion 210 over the first side portion 210 forms a fold corresponding to the second outer fold 124 of the second corner end 106.

In the illustrated embodiment, the width w0 of the first side portion 210 and the width w2 of the second side portion 213 are substantially the same than the width w4 of the central portion 214 of the paperboard sheet 200. Alternatively, the first side portion 210 and/or the second side portion 213 could have a width which is substantially smaller than the width of the central portion 214. The width w of the paper sheet thus corresponds to the sum of the widths w0, w2 and w3. The folds are formed from the sheet of paper that is continuously unwound from the paper roll at the start of the production line, by mechanical guides and fingers that gradually bend and form the folds 120 and 124, as the paper sheet passes through the guides.

As shown in FIG. 4C, folding the first and second side portions 210, 213 forms a first multilayered intermediate sheet 300. More specifically, the first multilayered intermediate sheet 300 includes three layers, corresponding to the first and second side portions 210, 213 and the central portion 214 of the paperboard sheet 200.

Figure 4D:
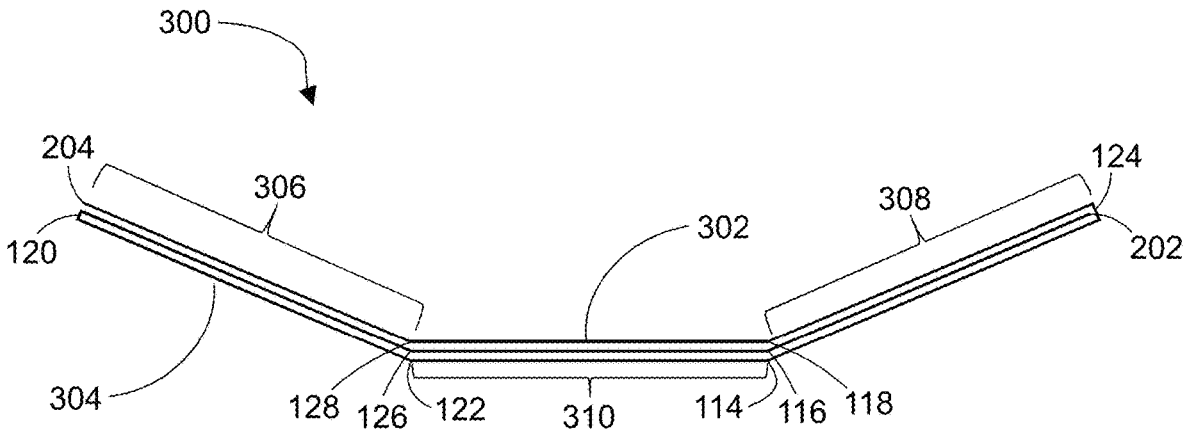

In one embodiment, the first multilayered intermediate sheet 300 is then folded onto itself again to increase the thickness of the paperboard protective corner 100 as well as to provide additional folds to the paperboard protective corner 100 to further strengthen the paperboard protective corner 100. Specifically, as shown in FIGS. 4C and 4D, the first multilayered intermediate sheet 300 has a first multilayer face 302 and a second multilayer face 304 and further includes a first multilayer side portion 306, a second multilayer side portion 308 and a multilayer central portion 310 extending between the first and second multilayer side portions 306, 308, the multilayer portions being all formed from the single paperboard sheet 200. Specifically, the second side edge 204 of the paperboard sheet 200 and the inner fold 120 of the first corner end 104 are located at the first side portion 306, and the first side edge 202 of the paperboard sheet 200 and the second outer fold 124 of the second corner end 106 are located at the second end portion 308.

Figure 4E:
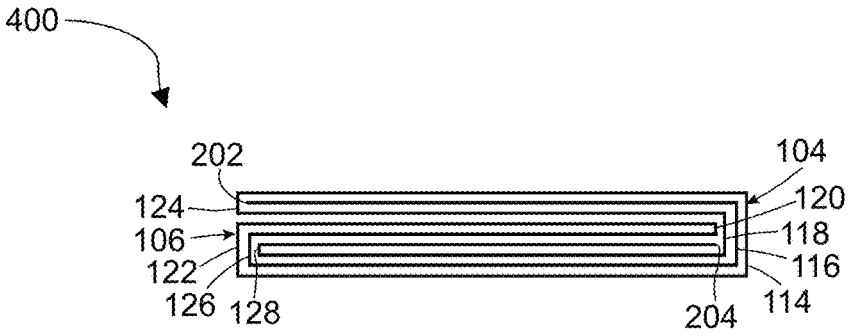

As shown in FIGS. 4D and 4E, the first multilayered intermediate sheet 300 is folded according to a second folding pattern. In this embodiment, the second folding pattern is similar to the first folding pattern. Specifically, the first and second side portions 306, 308 are folded towards each other and on the central multilayer portion 310. More specifically, the first side portion 306 is folded onto the central portion 310 such that the first face 302 of the first side portion 306 extends over the first face 302 of the central portion 310. The second side portion 308 is then folded onto the first side portion 306 such that the first face 302 of the second side portion 308 extends along the second face 304 of the first side portion 306.

In the illustrated embodiment, the first and second multilayer side portions 306, 308 and the central multilayer portion 310 of the first multilayered intermediate sheet 300 have substantially the same width. Alternatively, the first multilayer side portion 306 and/or the second multilayer side portion 308 could have a width which is substantially smaller than the width of the central multilayer portion 310.

As shown in FIG. 4E, folding the first and second multilayer side portions 306, 308 of the first multilayered sheet 300 over the central multilayer portion 310 forms a second multilayered intermediate sheet 400. More specifically, the second multilayered intermediate sheet 400 includes nine layers, corresponding to the first and second multilayer side portions 306, 308 and the central portion 310 of the paperboard sheet 200 which each comprise three layers. Similar to the folds formed in the paperboard sheet, the folds in the first multilayered sheet 300 are formed in-line, for example using mechanical guides and fingers that gradually bend and form the different folds, as the paper sheet passes through the guides. In particular, folding the first side multilayer side portion 306 over the central multilayer portion 310 forms three folds corresponding successively from the outside to the inside, or from the left to the right on FIG. 4E, first outer fold 122, intermediate fold 126 and inner fold 128 of the second corner end 106, and folding the second multilayer side portion 308 over the first multilayer side portion 306 forms three folds corresponding successively from the outside to the inside, or from the right to the left on FIG. 4E, to the outer fold 114, first intermediate fold 116 and second intermediate fold 118 of the first corner end 104.

In the illustrated embodiment, the second multilayered intermediate sheet 400 is then bent at an angle of about 90 degrees substantially at its center to form the central apex 112 and the first and second wings 108, 110 on either side of the central apex 112, as shown in FIG. 3.

Figure 5:
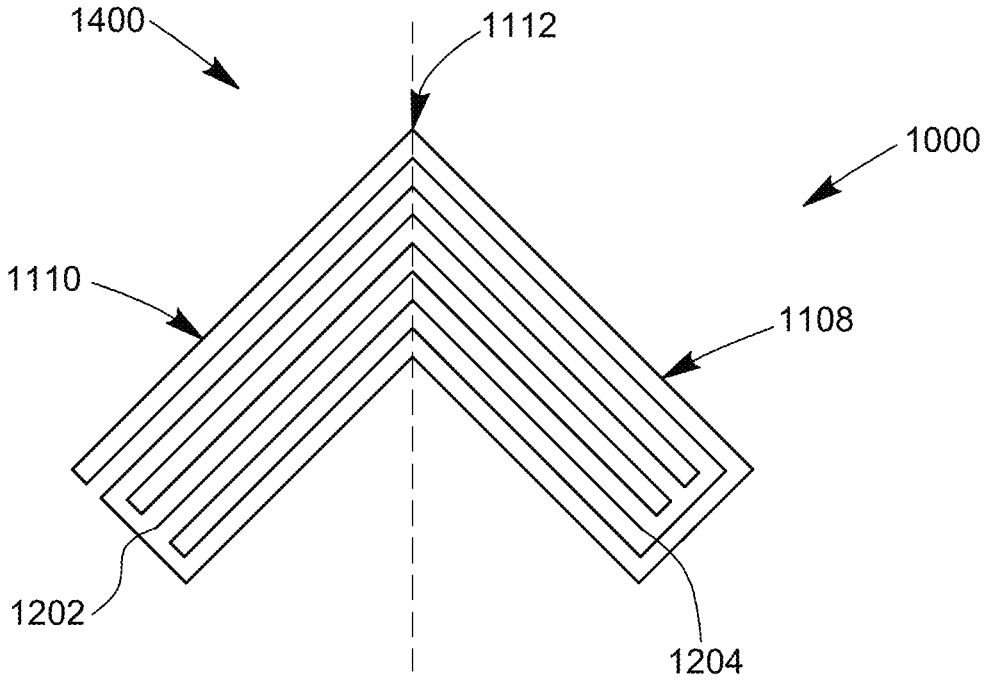
FIG. 5 is a cross-section view of a paperboard protective corner, in accordance with a second embodiment.
Figure 7:
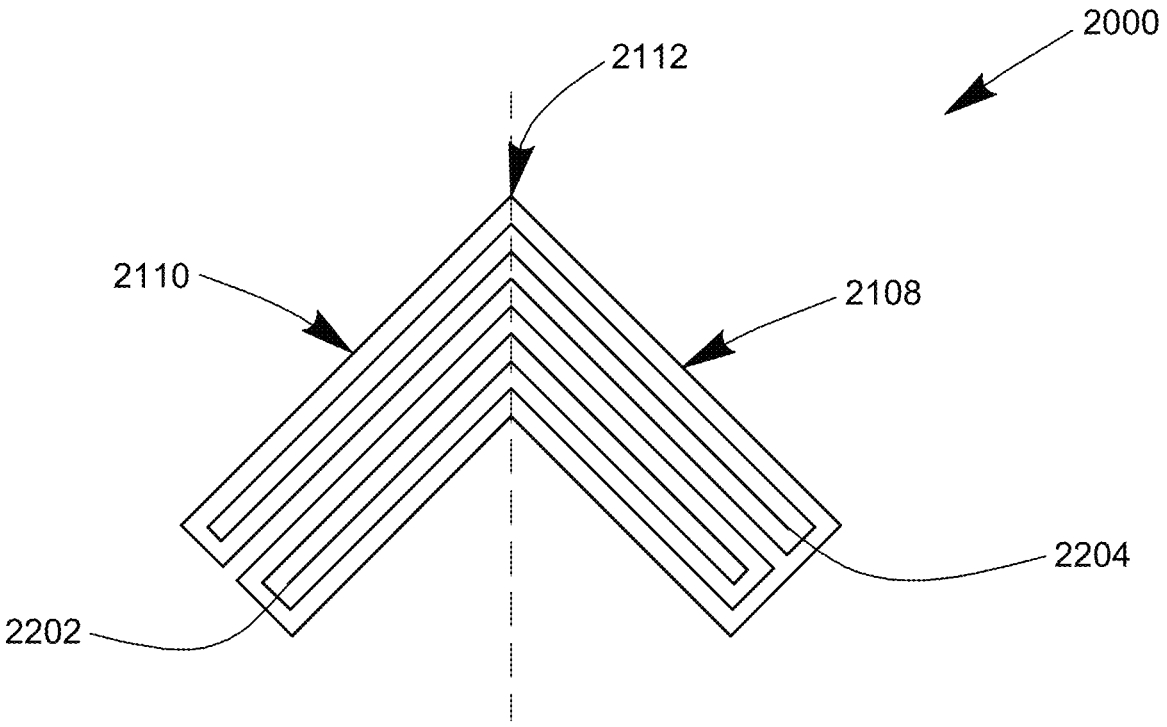
FIG. 7 is a cross-section view of a paperboard protective corner, in accordance with a third embodiment.
Figure 9:
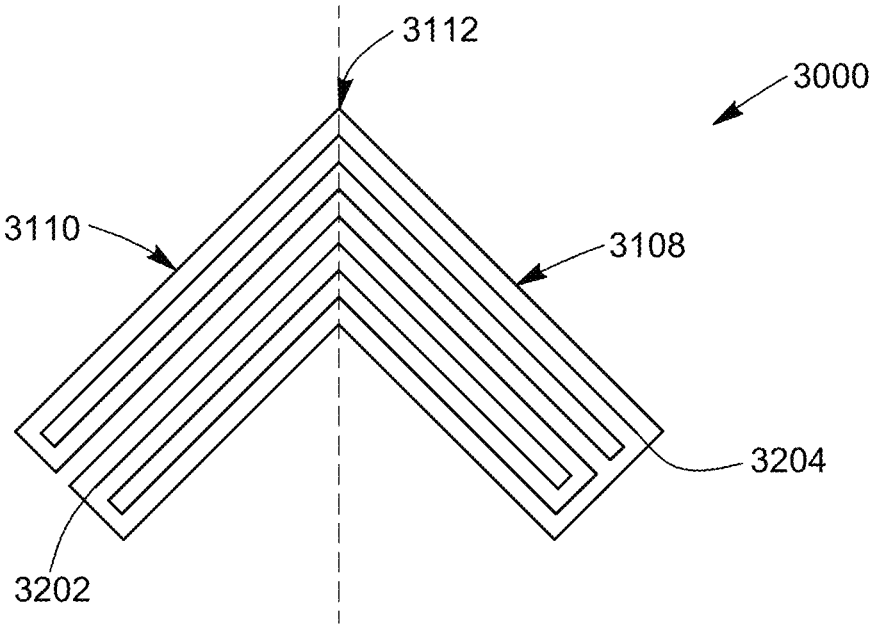
FIG. 9 is a cross-section view of a paperboard protective corner, in accordance with a fourth embodiment.

Referring now to FIGS. 5, 7 and 9, there are provided three paperboard protective corners 1000, 2000 and 3000, in accordance with a second, third and fourth embodiments. In these embodiments, the paperboard protective corners 1000, 2000 and 3000 include a single paperboard sheet 200 which is folded onto itself to form the paperboard protective corner 100 having nine (9) layers from the same paperboard sheet.

FIGS. 6A to 61, 8A to 81 and 10A to 10 G show the different steps of the process to manufacture the paperboard protective corners 1000, 2000 and 3000, respectively, with the paperboard sheet 200 is first provided.

Second Embodiment—9 Layers

Figure 6A:
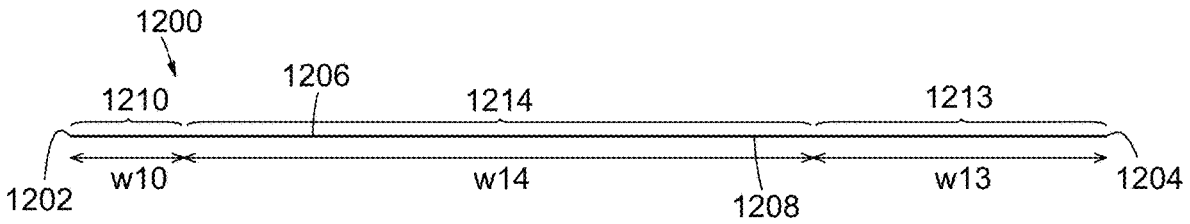
FIGS. 6A to 6I are front elevation views showing folding steps of a method for manufacturing the paperboard protective corner illustrated in FIG. 5, in accordance with one embodiment.

Referring to FIGS. 5 and 6A to 61, there is shown a second embodiment of the paperboard protective corner wherein the features are numbered with reference numerals in the 1000 series which correspond to the reference numerals of the previous embodiment.

As shown in FIG. 6A, the paperboard sheet 1200 includes a first side portion 1210 located adjacent the first side edge 1202, a second side portion 1213 located adjacent the second side edge 1204 and a central portion 1214 extending between the first and second side portions 1210, 1213.

In the illustrated embodiment, the width w10 of the first side portion 1210 is substantially equal to $1/9^{th}$ of the total width w of the paperboard sheet 1200, and the width w13 of the second side portion 1213 is substantially equal to $1/3^{rd}$ of the total width w of the paperboard sheet 1200. The width w14 of the central portion 1214 is substantially equal to $5/9^{th}$ of the total width w of the paperboard sheet 1200.

Figure 6B:
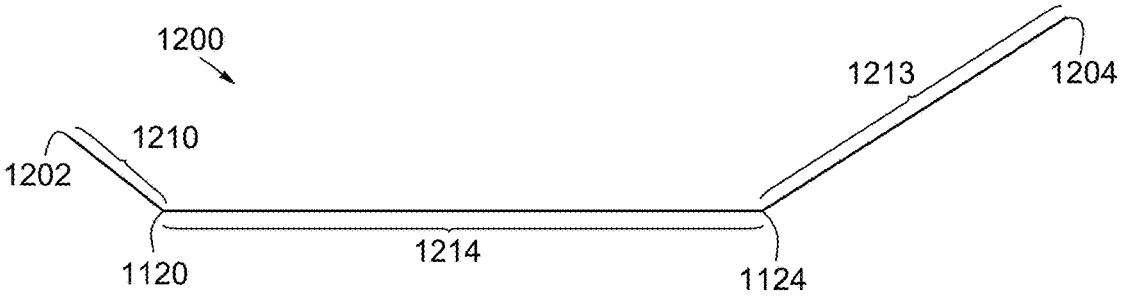
Figure 6C:
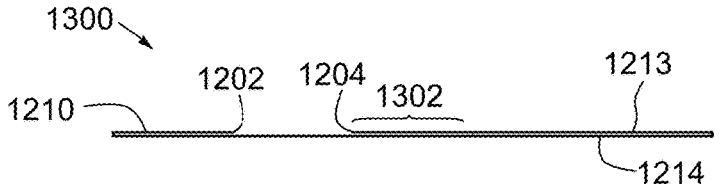

As shown in FIGS. 6B and 6C, the paperboard sheet 1200 is folded according to a first folding pattern. Specifically, the paperboard sheet 1200 is folded such that the first and second side portions 1210, 1213 are folded on the central portion 1214. More specifically, the first side portion 1210 is folded onto the central portion 1214 such that the first face 1206 of the first side portion 1210 extends over the first face 1206 of the central portion 1214. The second side portion 1213 is then folded onto the first side portion 1210 such that the first face 1206 of the second side portion 1213 extends along the second face 1208 of the first side portion 1210.

As shown in FIG. 6C, folding the first and second side portions 1210, 1213 forms a first multilayered intermediate sheet 1300.

In one embodiment, the second side portions 1213 includes a first side sub-portion 1302 located adjacent the second side edge 1204 and a second side sub-portion 1305 located adjacent a second outer fold 1124. The width of the second side sub-portion 1305 is substantially twice the width of the first side sub-portion 1302.

Figure 6D:
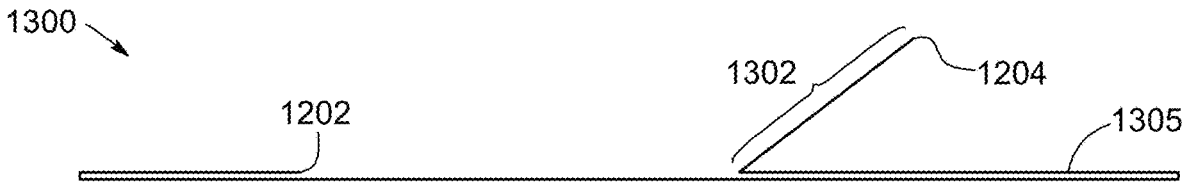
Figure 6E:
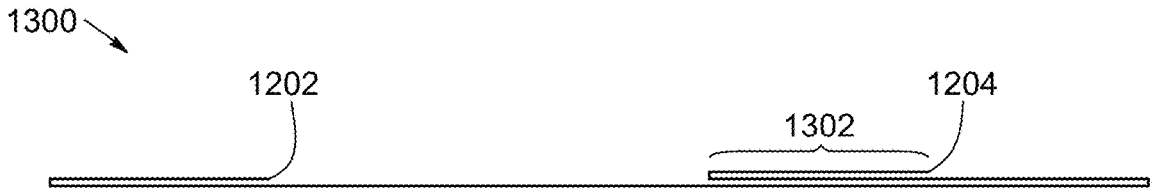

As shown in FIGS. 6D and 6E, the first side sub-portion 1302 is folded onto the second side sub-portion 1305. More specifically, the first side sub-portion 1302 is folded onto the second side sub-portion 1305 such that an upper face of the first side sub-portion 1302 extends over an upper face of the second side sub-portion 1305.

Figure 6F:
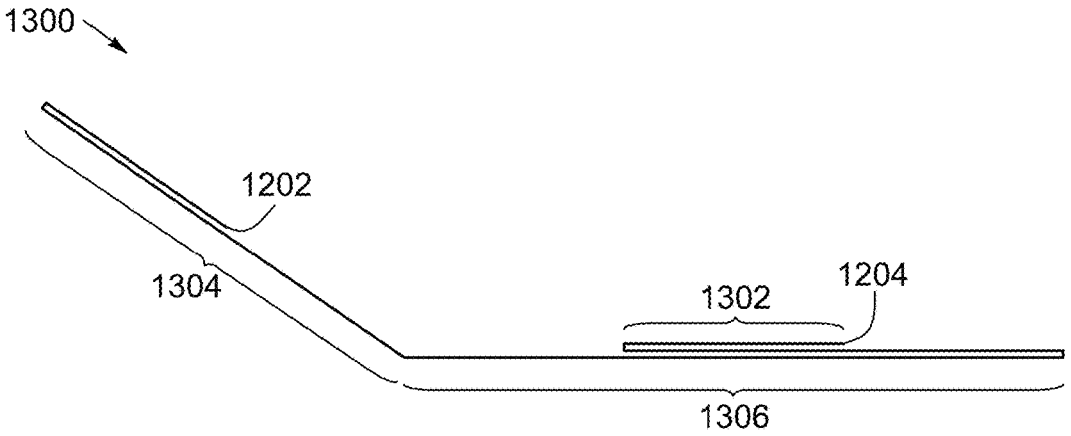
Figure 6G:
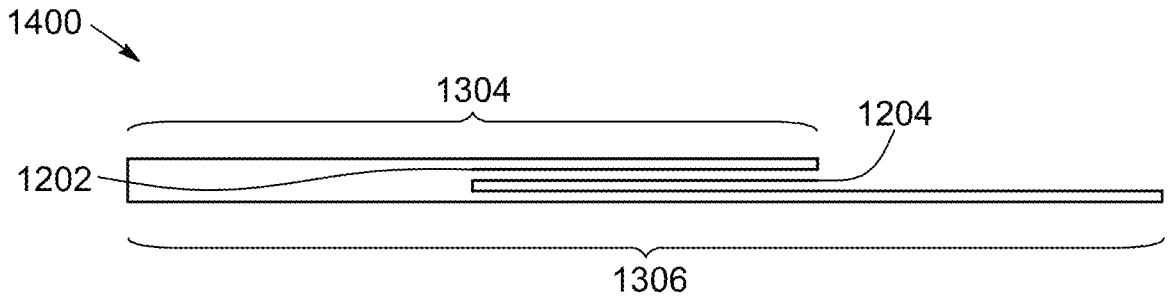

As shown in FIGS. 6F and 6G, the first multilayered intermediate sheet 1300 is folded according to a second folding pattern. Specifically, the first and second side portions 1304 and 1306 are folded towards each other. More specifically, the first side portion 1304 is folded onto the second side portion 1306 such that an upper face of the first side portion 1304 extends over an upper face of the second side portion 1306.

In the illustrated embodiment, the first and second side portions 1304, 1306 of the first multilayered intermediate sheet 1300 have a width ratio of substantially ⅔, i.e., the width of the first side portion 1304 is substantially $2/5^{th}$ of the total width of the first multilayered intermediate sheet 1300, and the width of the second side portion 1306 is substantially $3/5^{th}$ of the total width of the first multilayered intermediate sheet 1300.

Figure 6H:
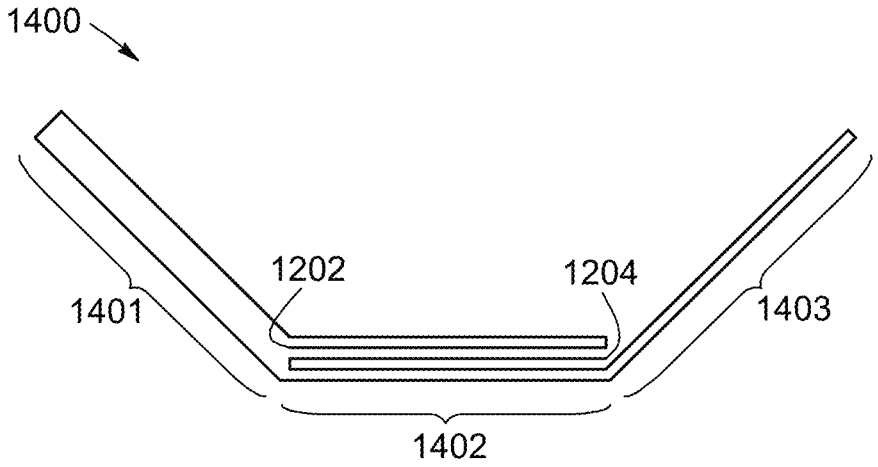
Figure 6I:
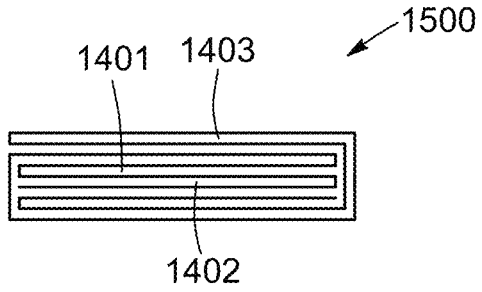

As shown in FIGS. 6G and 6H, folding the first and second side portions 1304, 1306 of the first multilayered sheet 1300 towards each other forms a second multilayered intermediate sheet 1400. More specifically, the second multilayered intermediate sheet 1400 includes a first side portion 1401, a second side portion 1403 and a central portion 1402 extending between the first and second side portions 1401, 1403. The second multilayered intermediate sheet 1400 includes two layers for the first and second side portions 1401, 1403, and includes five layers for the central portion 1402. Specifically, the first side edge 1202 and the second side edge 1204 of the paperboard sheet 1200 are both located in the middle layers of the central portion 1402 (respectively the second and third layers starting from the upper layer), such that both first side edge 1202 and second side edge 1204 are recovered by the fold of the first and second side portions 1401, 1403.

Referring to FIG. 61, folding the first and second side portions 1401, 1403 of the second multilayered intermediate sheet 1400 over the central portion 1402 forms a third multilayered intermediate sheet 1500. More specifically, the first side portion 1401 is folded onto the central portion 1402, such that an upper face of the first side portion 1401 extends over an upper face of the central portion 1402, and thereafter the second side portion 1403 is folded onto the first side portion 1401, such that an upper face of the second side portion 1403 extends over a lower face of the first side portion 1401.

In the illustrated embodiment, the third multilayered intermediate sheet 1500 is then bent at an angle of about 90 degrees substantially at its center to form the central apex 1112 and the first and second wings 1108, 1110 on either side of the central apex 1112, as shown in FIG. 5.

Third Embodiment—9 Layers

Referring to FIG. 7, there is shown a third embodiment of the paperboard protective corner wherein the features are numbered with reference numerals in the 2000 series which correspond to the reference numerals of the first embodiment.

Figure 8A:
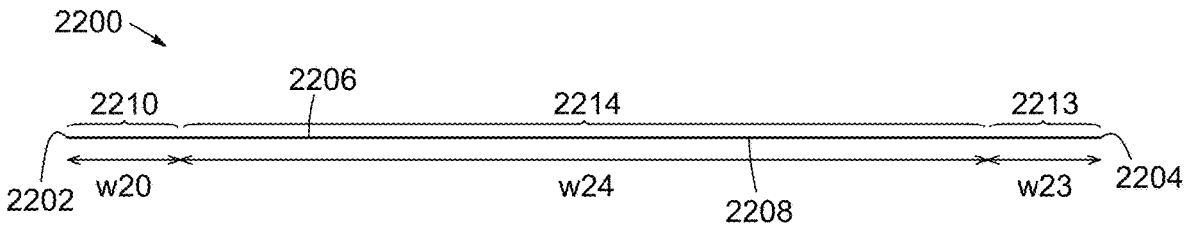
FIGS. 8A to 8I are front elevation views showing folding steps of a method for manufacturing the paperboard protective corner illustrated in FIG. 7, in accordance with one embodiment.

As shown in FIG. 8A, the paperboard sheet 2200 includes a first side portion 2210 located adjacent the first side edge 2202, a second side portion 2213 located adjacent the second side edge 2204 and a central portion 2214 extending between the first and second side portions 2210, 2213.

In the illustrated embodiment, the width w20 of the first side portion 2210 and the width w23 of the second side portion 2213 are substantially equal together and correspond substantially to $1/9^{th}$ of the total width w of the paperboard sheet 2200. The width w24 of the central portion 2214 is substantially equal to $7/9^{th}$ of the total width w of the paperboard sheet 1200.

Figure 8B:
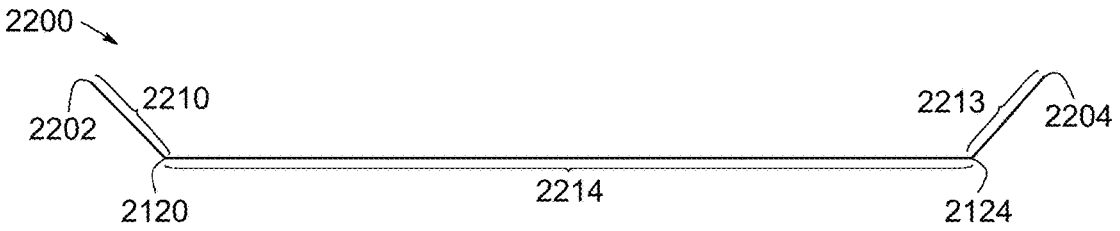
Figure 8C:
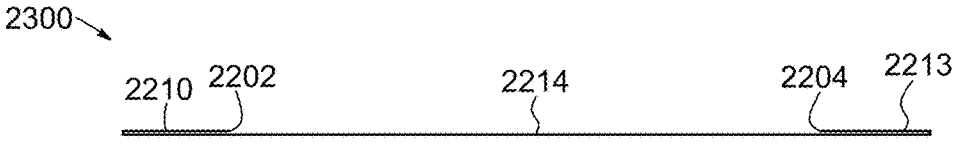

As shown in FIGS. 8B and 8C, the paperboard sheet 2200 is folded according to a first folding pattern. Specifically, the paperboard sheet 2200 is folded symmetrically, such that the first and second side portions 2210, 2213 are folded toward the central portion 2214. More specifically, the first side portion 2210 is folded onto the central portion 2214 such that the first face 2206 of the first side portion 2210 extends over the first face 2206 of the central portion 2214. The second side portion 2213 is also folded onto the first side portion 2210 such that the first face 2206 of the second side portion 1213 extends over the first face 2206 of the central portion 2214.

As shown in FIG. 8C, folding the first and second side portions 2210, 2213 forms a first multilayered intermediate sheet 2300.

Figure 8D:
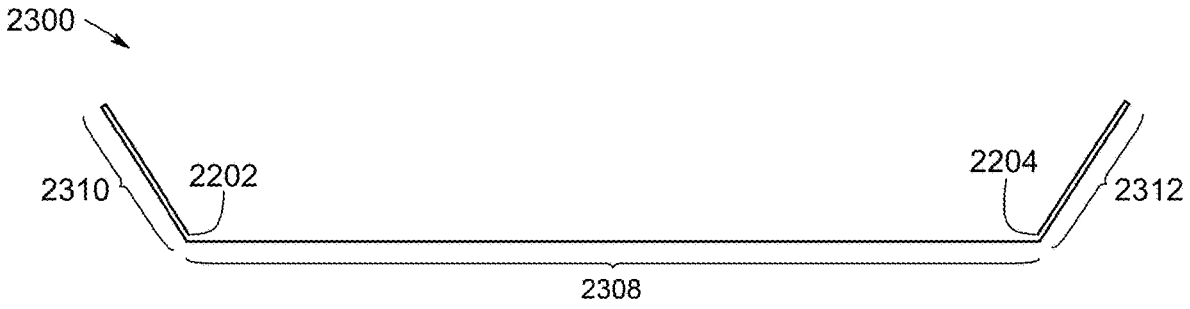
Figure 8E:
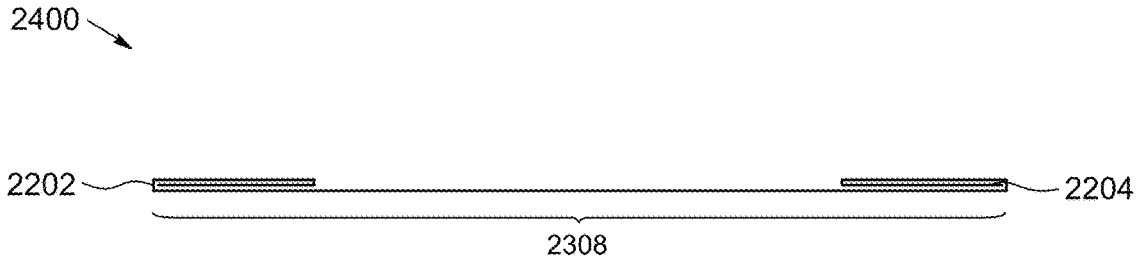

As shown in FIGS. 8D and 8E, the first multilayered intermediate sheet 2300 includes a first side portion 2310, a second side portion 2312 and a central portion 2308 extending between the first and second side portions 2310, 2312. The first multilayered intermediate sheet 2300 is then folded in the same first folding pattern as in FIGS. 8B and 8C. Specifically, the first multilayered intermediate sheet 2300 is folded symmetrically, such that the first and second side portions 2310, 2312 are folded toward the central portion 2308.

Figure 8F:
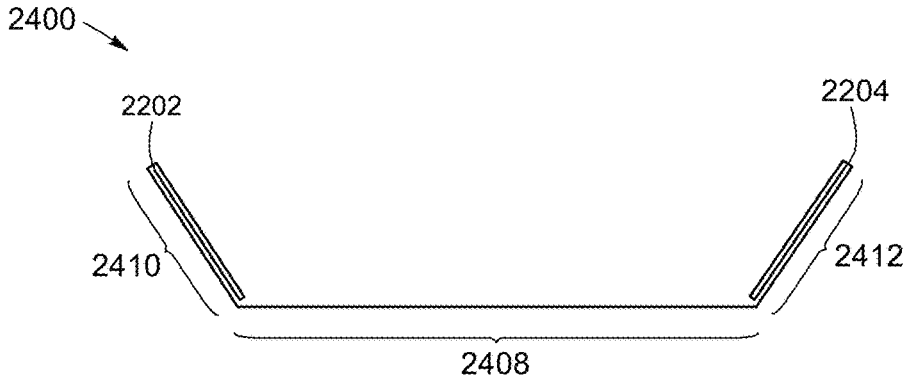

As shown in FIGS. 8E and 8F, folding the first and second side portions 2310, 2312 of the first multilayered sheet 2300 towards the central portion 2308 forms a second multilayered intermediate sheet 2400. More specifically, the second multilayered intermediate sheet 2400 includes a first side portion 2410, a second side portion 2412 and a central portion 2408 extending between the first and second side portions 2410, 2412. The second multilayered intermediate sheet 2400 includes three layers for the first and second side portions 2410, 2412, and includes one layer for the central portion 2408. Specifically, the first side edge 2202 and the second side edge 2204 of the paperboard sheet 2200 are both located in the middle layer of the first and second side portions 2410, 2412, such that both first side edge 2202 and second side edge 2204 are recovered by the fold of the first and second side portions 2410, 2412.

Figure 8G:
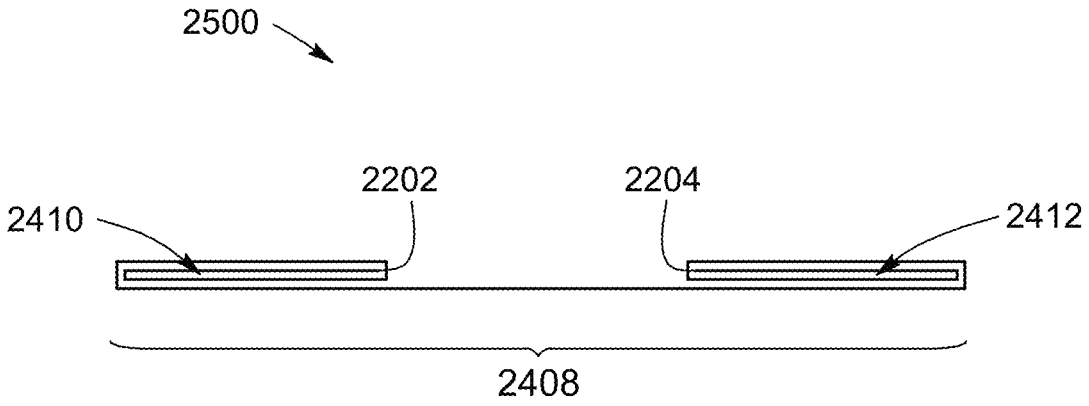

As shown in FIGS. 8F and 8G, the second multilayered intermediate sheet 2400 is then folded in the same first folding pattern as in FIGS. 8B and 8C. Specifically, the second multilayered intermediate sheet 2400 is folded symmetrically, such that the first and second side portions 2410, 2412 are folded toward the central portion 2408.

Figure 8H:
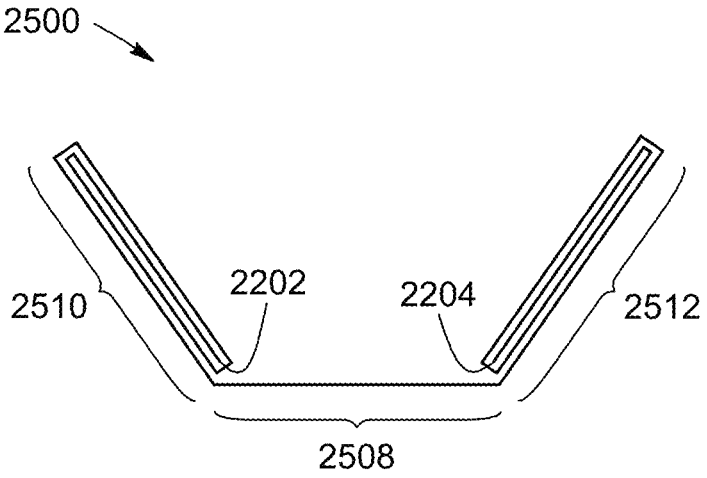

As shown in FIGS. 8G and 8H, folding the first and second side portions 2410, 2412 of the second multilayered sheet 2400 towards the central portion 2408 forms a third multilayered intermediate sheet 2500. More specifically, the third multilayered intermediate sheet 2500 includes a first side portion 2510, a second side portion 2512 and a central portion 2508 extending between the first and second side portions 2510, 2512. The second multilayered intermediate sheet 2500 includes four layers for the first and second side portions 2510, 2512, and includes one layer for the central portion 2508. In particular, the first and second side portions 2510, 2512 have a width significantly equal to the width of the central portion 2508.

Figure 8I:
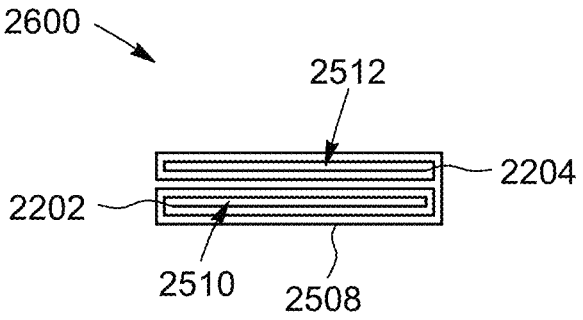

Referring to FIG. 8I, folding the first and second side portions 2510, 2512 of the third multilayered intermediate sheet 2500 over the central portion 2508 forms a fourth multilayered intermediate sheet 2600. More specifically, the first side portion 2510 is first folded onto the central portion 2508, such that an upper face of the first side portion 2510 extends over an upper face of the central portion 2508, and thereafter the second side portion 2512 is folded onto the first side portion 2510, such that an upper face of the second side portion 2512 extends over a lower face of the first side portion 2510.

In the illustrated embodiment, the fourth multilayered intermediate sheet 2600 is then bent at an angle of about 90 degrees substantially at its center to form the central apex 2112 and the first and second wings 2108, 2110 on either side of the central apex 2112, as shown in FIG. 7.

Fourth Embodiment—9 Layers

Referring to FIG. 9, there is shown a fourth embodiment of the paperboard protective corner 3000 wherein the features are numbered with reference numerals in the 3000 series which correspond to the reference numerals of the first embodiment.

Figure 10A:
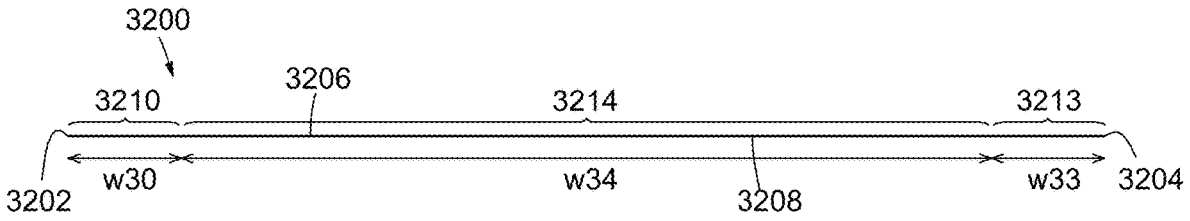
FIGS. 10A to 10G are front elevation views showing folding steps of a method for manufacturing the paperboard protective corner illustrated in FIG. 9, in accordance with one embodiment.

As shown in FIG. 10A, the paperboard sheet 3200 includes a first side portion 3210 located adjacent the first side edge 3202, a second side portion 3213 located adjacent the second side edge 3204 and a central portion 3214 extending between the first and second side portions 3210, 3213.

In the illustrated embodiment, the width w30 of the first side portion 3210 and the width w33 of the second side portion 3213 are substantially equal together and correspond substantially to $2/9^{th}$ of the total width w of the paperboard sheet 3200. The width w34 of the central portion 3214 is substantially equal to $5/9^{th}$ of the total width w of the paperboard sheet 1200.

Figure 10B:
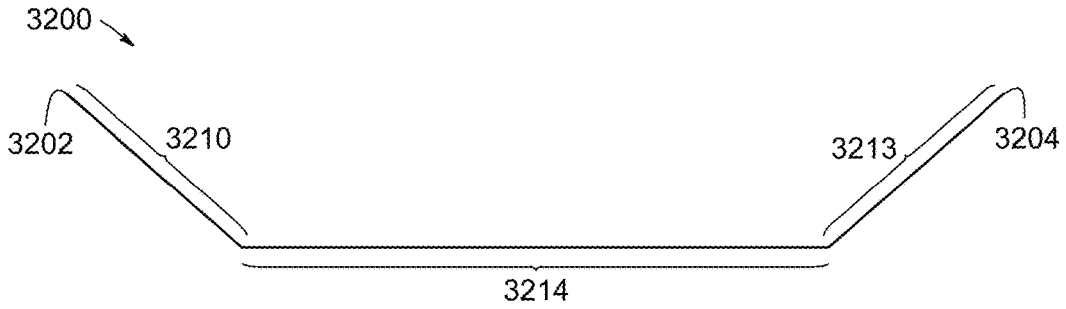
Figure 10C:
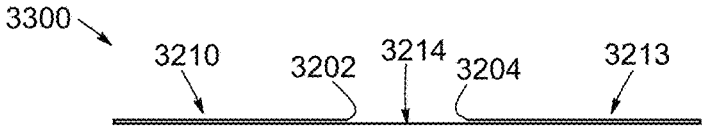

As shown in FIGS. 10B and 10C, the paperboard sheet 3200 is folded according to a first folding pattern. Specifically, the paperboard sheet 3200 is folded symmetrically, such that the first and second side portions 3210, 3213 are folded toward the central portion 3214. More specifically, the first side portion 3210 is folded onto the central portion 3214 such that the first face 3206 of the first side portion 3210 extends over the first face 3206 of the central portion 3214. The second side portion 3213 is also folded onto the first side portion 3210 such that the first face 3206 of the second side portion 3213 extends over the first face 3206 of the central portion 3214.

As shown in FIG. 100, folding the first and second side portions 3210, 3213 forms a first multilayered intermediate sheet 3300.

Figure 10D:
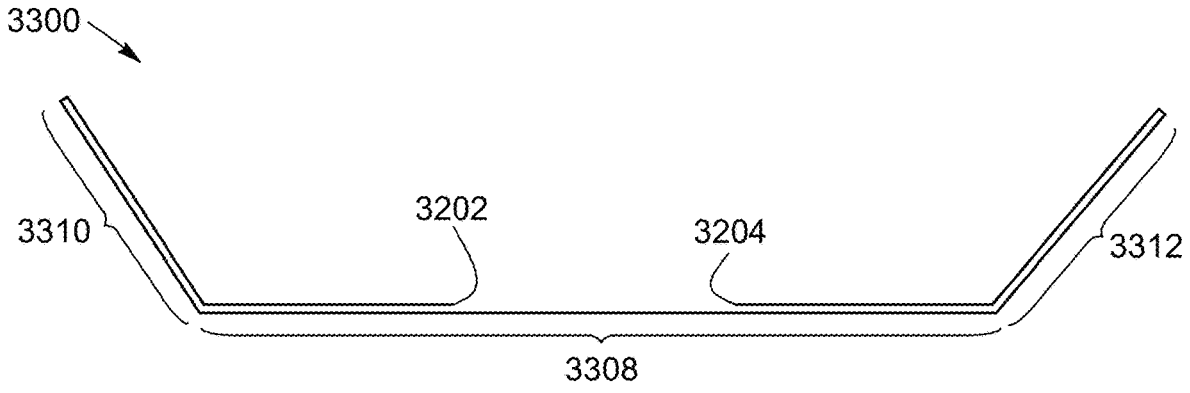
Figure 10E:
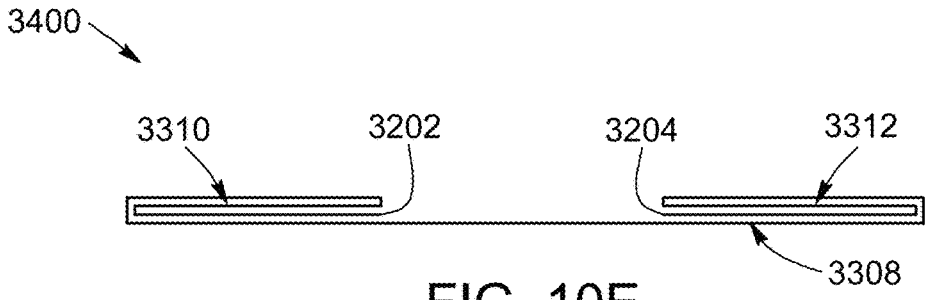

As shown in FIGS. 10D and 10E, the first multilayered intermediate sheet 3300 includes a first side portion 3310, a second side portion 3312 and a central portion 3308 extending between the first and second side portions 3310, 3312. The first multilayered intermediate sheet 3300 is then folded in the same first folding pattern as in FIGS. 10B and 100. Specifically, the first multilayered intermediate sheet 3300 is folded symmetrically, such that the first and second side portions 3310, 3312 are folded toward the central portion 3308.

Figure 10F:
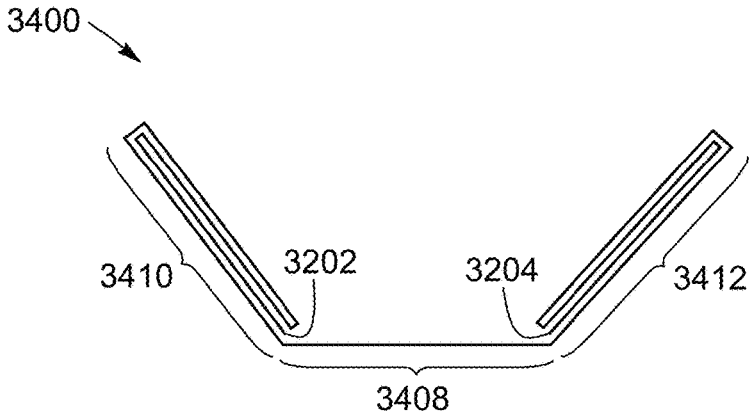

As shown in FIGS. 10E and 10F, folding the first and second side portions 3310, 3312 of the first multilayered sheet 3300 towards the central portion 3308 forms a second multilayered intermediate sheet 3400. More specifically, the second multilayered intermediate sheet 3400 includes a first side portion 3410, a second side portion 3412 and a central portion 3408 extending between the first and second side portions 3410, 3412.

The second multilayered intermediate sheet 3400 includes four layers for the first and second side portions 3410, 3412, and includes one layer for the central portion 3408. Specifically, the first side edge 3202 and the second side edge 3204 of the paperboard sheet 3200 are both located in the middle layers of the first and second side portions 3410, 3412, such that both first side edge 3202 and second side edge 3204 are recovered by the fold of the first and second side portions 3410, 3412.

Figure 10G:
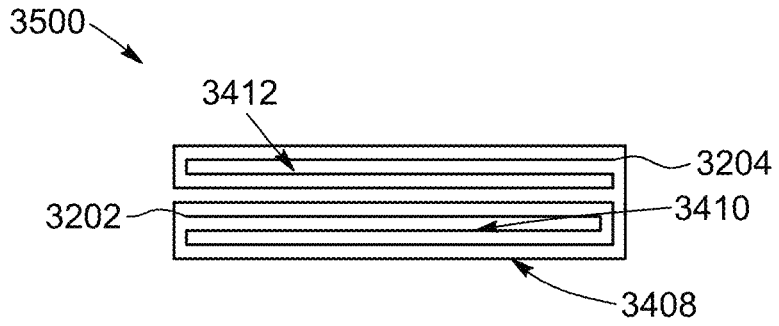

As shown in FIGS. 10F and 10G, the second multilayered intermediate sheet 3400 is then folded in the same first folding pattern as in FIGS. 10B and 100. Specifically, the second multilayered intermediate sheet 3400 is folded symmetrically, such that the first and second side portions 3410, 3412 are folded toward the central portion 3408.

Referring to FIG. 10G, folding the first and second side portions 3410, 3412 of the second multilayered intermediate sheet 3400 over the central portion 3408 forms a third multilayered intermediate sheet 3500. More specifically, the first side portion 3410 is first folded onto the central portion 3408, such that an upper face of the first side portion 3410 extends over an upper face of the central portion 3408, and thereafter the second side portion 3412 is folded onto the first side portion 3410, such that an upper face of the second side portion 3412 extends over a lower face of the first side portion 3410.

In the illustrated embodiment, the third multilayered intermediate sheet 3500 is then bent at an angle of about 90 degrees substantially at its center to form the central apex 3112 and the first and second wings 3108, 3110 on either side of the central apex 3112, as shown in FIG. 9.

As can be appreciated, the different embodiments described above are all formed of two multilayered sheets, where the wings of the paperboard protective corner comprise 9 layers in total from the same folded sheet, with the side edges of the sheet located and hidden inside the wings. It is believed that the combination of using a single continuous sheet folded at the corner ends preserves the integrity of the raw material forming the corner and thus allows providing resistance to crushing forces applied on the apex of at least 90 N, and preferably at least 200 N, and preferably at least 300 N for a corner wall thickness of 2 mm, without having to add a reinforcing core to the corner, nor using laminate made of several distinct sheets.

Fifth Embodiment—5 Layers

Figure 11:
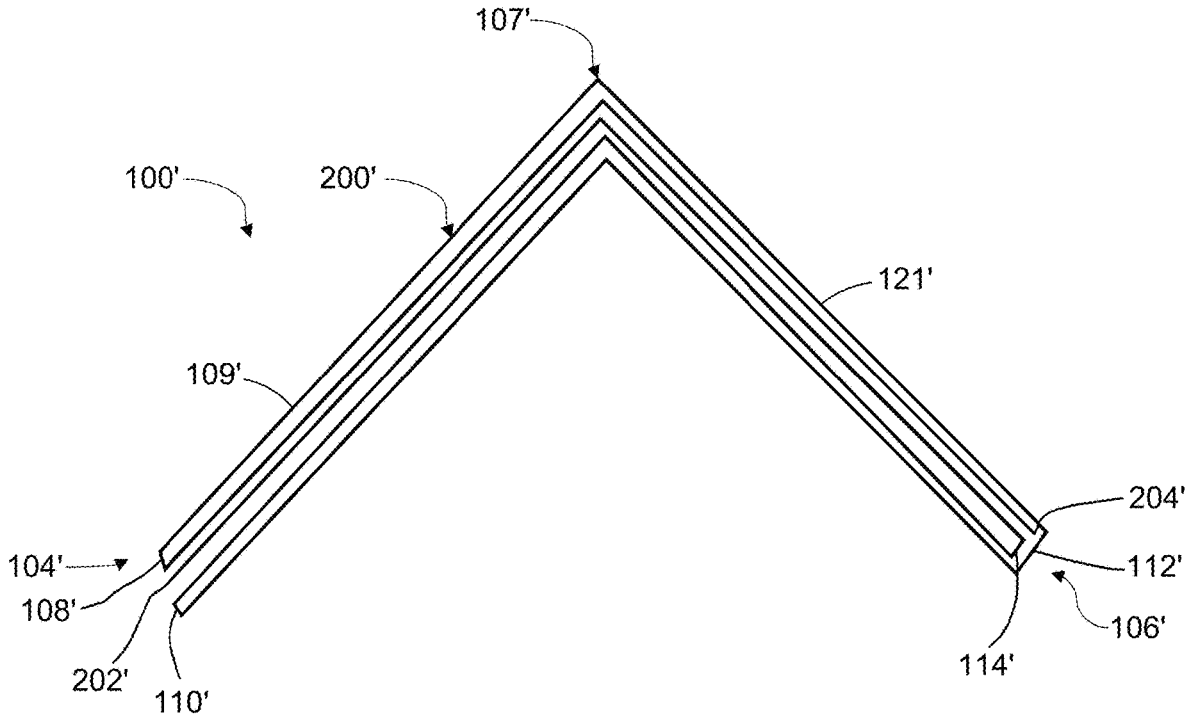
FIG. 11 is a cross-section view of a paperboard protective corner, in accordance with a fifth embodiment.

Turning to FIG. 11, there is shown a paperboard protective corner 100', in accordance with another embodiment. The paperboard protective corner 100' is made from a paperboard sheet 200' which extends between first and second side edges 202', 204' and which is folded onto itself. In the embodiment shown in FIGS. 11 and 12A to 12E, the paperboard protective corner 100' comprises five layers. Specifically, the paperboard protective corner 100' includes a corner body 102' extending between first and second corner ends 104', 106' and folded at a 90-degree angle to form a central apex 107'.

In this embodiment, the first corner end 104' includes first and second folds 108', 110' and the first side edge 202' of the paperboard sheet 200' received between the first and second folds 108', 110'. The second corner end 106' includes an outer fold 112' and an inner fold 114' nested in the outer fold 112', the second side edge 204' of the paperboard sheet 200' being received in the outer fold 112' alongside the inner fold 114'.

Figure 12A:
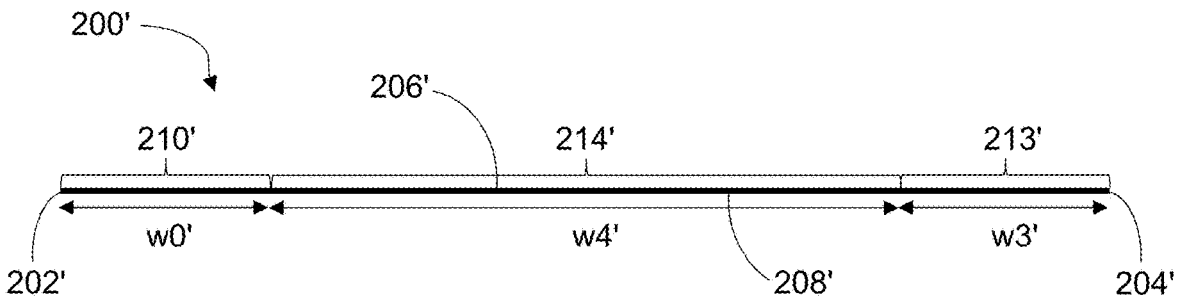
FIGS. 12A to 12E are front elevation views showing folding steps of a method for manufacturing the paperboard protective corner illustrated in FIG. 11, in accordance with one embodiment.

As shown in FIG. 12A, the paperboard sheet 200' includes a first side portion 210' located adjacent the first side edge 202', a second side portion 213' located adjacent the second side edge 204' and a central portion 214' extending between the first and second side portions 210', 213'.

In the illustrated embodiment, the width w0' of the first side portion 210' and the width w3' of the second side portion 213' are substantially equal together and correspond substantially to $1/5^{th}$ of the total width w of the paperboard sheet 200'. The width w4' of the central portion 214' is substantially equal to $3/5^{th}$ of the total width w of the paperboard sheet 200'.

In a preferred embodiment, the width w0' of the first side portion 210' can be significantly smaller than the width w3' of the second side portion 213', to ensure that the first side edge 202' of the paperboard sheet 200' is well nested and well protected between the first and second folds 108', 110'.

Figure 12B:
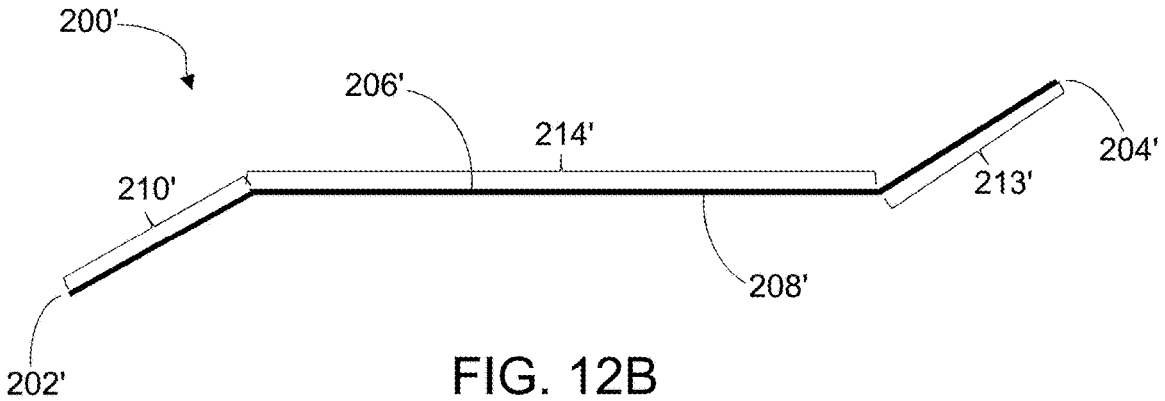
Figure 12C:
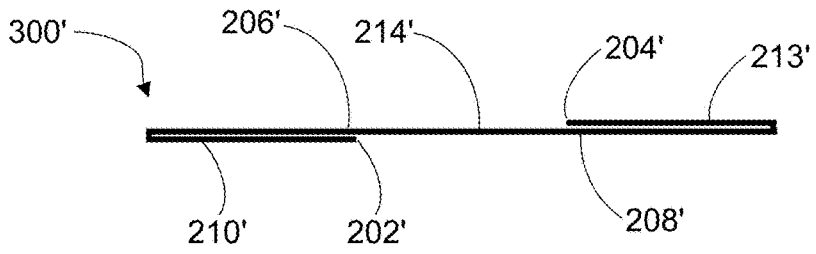

As shown in FIGS. 12B and 12C, the paperboard sheet 200' is folded according to a first folding pattern. Specifically, the paperboard sheet 200' is folded oppositely, such that the first side portion 210' is folded downwardly toward the central portion 214' and the second side portion 213' is folded upwardly toward the central portion 214'. More specifically, the first side portion 210' is folded onto the central portion 214' such that the second face 208' of the first side portion 210' extends over the second face 208' of the central portion 214', and the second side portion 213' is folded onto the central portion 214' such that the first face 206' of the second side portion 213' extends over the first face 206' of the central portion 214'.

As shown in FIG. 12C, folding the first and second side portions 210', 213' forms a first multilayered intermediate sheet 300'.

Figure 12D:
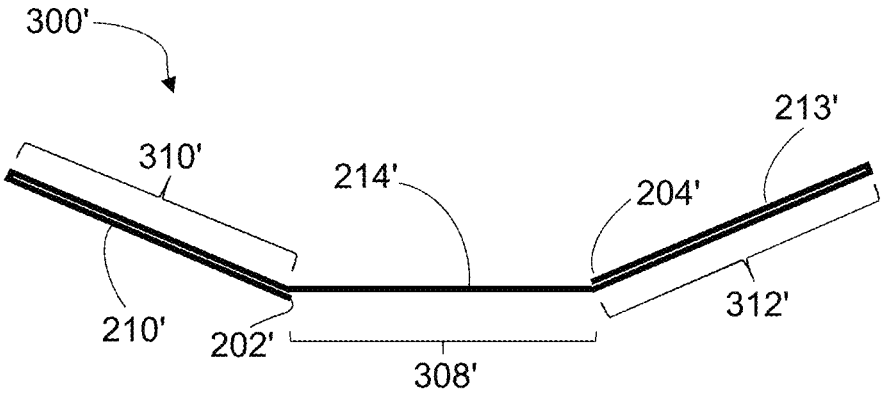
Figure 12E:
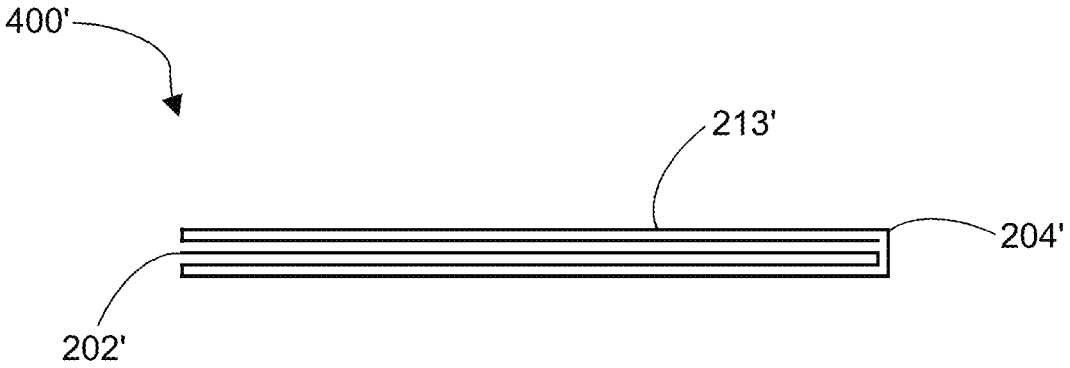

As shown in FIGS. 12D and 12E, the first multilayered intermediate sheet 300' includes a first side portion 310', a second side portion 312' and a central portion 308' extending between the first and second side portions 310', 312'. The first multilayered intermediate sheet 300 is then folded in a second folding pattern. Specifically, the first multilayered intermediate sheet 300' is folded symmetrically.

Referring to FIG. 12E, folding the first and second side portions 310', 312' of the first multilayered intermediate sheet 300' over the central portion 308' forms a second multilayered intermediate sheet 400'. More specifically, the first side portion 310' is first folded onto the central portion 308', such that an upper face of the first side portion 310' extends over an upper face of the central portion 308', and thereafter the second side portion 312' is folded onto the first side portion 310', such that an upper face of the second side portion 312' extends over a lower face of the first side portion 310'.

In the illustrated embodiment, the second multilayered intermediate sheet 400' is then bent at an angle of about 90 degrees substantially at its center to form the central apex 107' and the first and second wings 109', 121' on either side of the central apex 107', as shown in FIG. 11.

In this embodiment, the paperboard sheet 200' comprises five folds, including two folds at each corner end and the central apex 107' forming the fifth fold. Similar to the 9-layer paperboard protective corners, the side edges are hidden and nested inside the wings of the corner. This version of the paperboard protective corner is also manufactured in a continuous, in-line process, with the folds being formed as the paperboard sheet interacts with guides located along the production lines.

Sixth Embodiment—11 Layers

Figure 13:
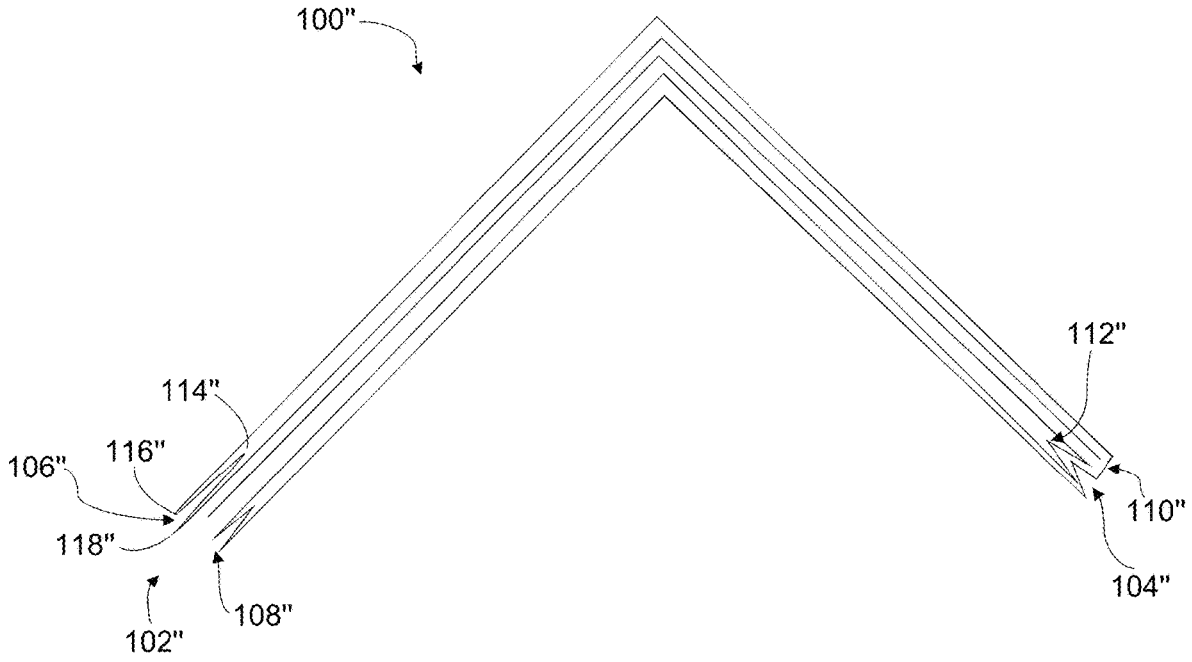
FIG. 13 is a cross-section view of a paperboard protective corner, in accordance with another embodiment.

Turning now to FIG. 13, there is shown a paperboard protective corner 100", in accordance with another embodiment. In this embodiment, the paperboard protective corner 100" extends between first and second corner ends 102", 104" and includes five layers, similar to the paperboard protective corner 100' illustrated in FIG. 10. In this embodiment, the first corner end 102" includes first and second folds 106", 108" and the second corner end 104" includes an outer fold 110" and an inner fold 112" nested in the outer fold 110". However, in this embodiment, each fold 106", 108", 110", 112" is in turn folded in on itself to form an inwardly-extending fold 114" disposed between two outwardly-extending folds 116", 118". In this embodiment, each fold is therefore turned into three folds. Specifically, according to this configuration, the paperboard protective corner 100" may include eleven folds. Such embodiment adds resistance force to the paperboard protective corner.

Adhesive

It will be understood that an adhesive such as glue or the like is further applied to the paperboard sheet 200 to allow the paperboard protective corner 100 to retain its final configuration. In one embodiment, the adhesive may be applied along the entire paperboard sheet 200 prior to folding. In another embodiment, the adhesive may be applied between each folding step as required. For example, stations to apply adhesive can be located near or between the mechanical guides that form the folds. Alternatively, the adhesive may be applied in any other suitable manner. The adhesive can include polyvinyl alcohol, polyvinyl acetate, sodium silicate-based glue, or polyurethane-based glue. In some embodiment, starch-based glue can be used, which will consistently increase rigidity but is not hydrophobic. The adhesive can be applied with a roller coat, a spray, a brush, a trowel, or any suitable tool.

Additional Embodiments

Alternatively, the paperboard protective corners as described above can further comprise an adhesive strip applied along the length of the protective corner, on each internal side of the first and second wings, to facilitate proper fixation on the goods to be protected.

The paperboard protective corners as described above can further comprise a coating, such as a Michelman® water-based coating for allowing the paperboard protective corner to adhere, grip or stick onto the product on which it is applied, preventing the paperboard protective corners to slide down from the goods to be protected.

Production Line

As explained previously, the paperboard protective corner 100 is preferably made on a paperboard protective corner production line which is configured to allow a plurality of paperboard protective corners to be manufactured successively. Specifically, the paperboard sheet 200 is unwound from a paper roll and is substantially long to allow the different folding and gluing steps to take place along the line, using static guides or mechanized fingers. The production line is configured to move the paperboard sheet 200 along a travel path, using for example rollers provided along the line, in a longitudinal direction (corresponding to a longitudinal direction of the paperboard protective corner) substantially continuously during the manufacturing process. The production line further includes folding stations that are located along the travel path, each folding station being configured to perform one or more of the folding operations disclosed above. For example, in one embodiment, the production line could include a first folding station configured for folding the first side portion 210 onto the central portion 214, a second folding station for folding the second side portion 213 onto the first side portion 210, a third folding station for folding the first side portion 306 of the multilayered intermediate sheet 300 onto the central portion 310, a fourth folding station for folding the second side portion 308 onto the first side portion 306 and a bending station to bend the second multilayered intermediate sheet 400 at an angle of about 90 degrees substantially at its center to form the central apex 112. In one embodiment, the production line can further include a cutting station located downstream from the folding station(s) to cut the paperboard protective corner to a desired length.

In one embodiment, the folding stations perform the folding operations while the paperboard sheet moves continuously along the travel path. More specifically, the production line can be configured to perform the above folding operations while the paperboard sheet moves along the travel path at a substantially constant speed. In this case, manufacturing the paperboard protective corner 100 using a single paperboard sheet may allow the paperboard sheet to be moved along the travel path at a substantially higher speed than if the corner was made from multiple paperboard sheets, which may therefore increase the production rate of the paperboard protective corners. For example, in one embodiment, the paperboard sheet may be moved longitudinally along the travel path at a speed of between about 0 m/s and 300 m/s, or at a speed of more than 200 m/s. Alternatively, the paperboard sheet may be moved along the travel path at any other suitable speed.

In one embodiment, the paperboard sheet 200 could be an existing paperboard sheet having a standard width and the folding operations disclosed above could form a paperboard protective corner 100 having a desired size. This would allow paperboard protective corners of the desired size to be manufactured without having to pre-cut the paperboard sheet to reduce its width in order to obtain a paperboard protective corner 100 having the desired size. Alternatively, the paperboard sheet 200 could be pre-cut to reduce its width in order to obtain a paperboard protective corner having the desired size.

It will be understood that the configuration and folding patterns described above are merely provided as examples and that various alternative configurations could be considered. In all possible alternative configurations, the first and second side edges 202, 204 of the carboard sheet 200 are well nested in a fold, to prevent the first and second side edges 202, 204 to be free and subject to peeling.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A paperboard protective corner comprising:

a corner body made of a single paperboard sheet comprising first and second side edges, the single paperboard sheet being an unlaminated paperboard sheet having a thickness between about 6 pts and about 17 pts, the single paperboard sheet being folded onto itself to define first and second wings having each at least five layers from the single paperboard sheet, the first and second wings having first and second corner ends each comprising a plurality of folds, both the first and second side edges being nested in or adjacent to a corresponding fold so as to be unexposed to an exterior of the paperboard protective corner, wherein the single paperboard sheet is folded according to a first folding pattern to form a first multilayered intermediate sheet, the first multilayered intermediate sheet being further folded according to a second folding pattern to form a second multilayered intermediate sheet, the second multilayered intermediate sheet being bent at an angle of about 90 degrees to form an apex of the paperboard protective corner.

2. The paperboard protective corner of claim 1, the first and second wings being angled relative to each other to form the apex therebetween, the apex resisting a crushing force of at least 90 N.

3. The paperboard protective corner of claim 2, wherein a thickness of the first and second wings is 2 mm or more, the apex resisting a crushing force of at least 300 N.

4. The paperboard protective corner of claim 3, wherein a thickness of the first and second wings is between 2 mm and 5 mm, the apex resisting a crushing force between 300 N to 5700 N.

5. The paperboard protective corner of claim 1, wherein the second folding pattern is similar to the first folding pattern.

6. The paperboard protective corner of claim 1, wherein the corner body extends between the first and second corner ends, and wherein the plurality of folds includes a first plurality of folds located at the first corner end, the first plurality of folds including an outer fold, a first intermediate fold nested in the outer fold, a second intermediate fold nested into the first intermediate fold and an inner fold nested into the second intermediate fold.

7. The paperboard protective corner of claim 6, wherein the plurality of folds further includes a second plurality of folds located at the second corner end, the second plurality of folds including a first outer fold and a second outer fold located adjacent to the first outer fold.

8. The paperboard protective corner of claim 7, wherein the first and second wings each comprises nine layers from the single paperboard sheet.

9. The paperboard protective corner of claim 1, wherein the single paperboard sheet has a grammage of between about 100 $g/m^2$ and about 380 $g/m^2$.

10. The paperboard protective corner of claim 1, wherein the plurality of folds includes more than four folds.

11. The paperboard protective corner of claim 1, wherein a thickness of the first and second wings is between 2 mm and 5 mm, the apex resisting a crushing force between 300 N to 5700 N.

12. The paperboard protective corner of claim 1, further comprising folding the second multilayered intermediate sheet according to a third folding pattern to form a third multilayered intermediate sheet, the third multilayered intermediate sheet being bent at an angle of about 90 degrees to form the apex of the paperboard protective corner.

13. The paperboard protective corner of claim 12, wherein the third folding pattern is similar to the first folding pattern.

14. The paperboard protective corner of claim 10, wherein the plurality of folds includes five folds.

15. The paperboard protective corner of claim 10, wherein the plurality of folds includes nine folds.

16. The paperboard protective corner of claim 1, further comprising an adhesive applied to the paperboard sheet prior to folding.

17. The paperboard protective corner of claim 1 wherein a length of the first wing equals a length of the second wing, and the paperboard protective corner is symmetrical.

* * * * *